US008229327B2

(12) United States Patent
Cho et al.

(10) Patent No.: US 8,229,327 B2
(45) Date of Patent: Jul. 24, 2012

(54) IMAGE FORMING APPARATUS AND VELOCITY CONTROL METHOD OF ROTATING BODY THEREOF

(75) Inventors: Hyun-Ki Cho, Hanam-si (KR); Sung-Dae Kim, Suwon-si (KR); Jong-Tae Kim, Gwacheon-si (KR); Dong-Hoon Han, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/575,106

(22) Filed: Oct. 7, 2009

(65) Prior Publication Data

US 2010/0104321 A1 Apr. 29, 2010

(30) Foreign Application Priority Data

Oct. 23, 2008 (KR) ..... 10-2008-0104484

(51) Int. Cl.
*G03G 15/00* (2006.01)

(52) U.S. Cl. ..... 399/167

(58) Field of Classification Search ..... 399/159, 399/167

See application file for complete search history.

(56) References Cited

U.S. PATENT DOCUMENTS

2007/0242980 A1* 10/2007 Kikuchi et al. ..... 399/167

FOREIGN PATENT DOCUMENTS

JP 2006047920 A * 2/2006

OTHER PUBLICATIONS

Office Action mailed Jan. 11, 2012 in co-pending U.S. Appl. No. 13/200,344.

* cited by examiner

*Primary Examiner* — David Porta
*Assistant Examiner* — Milton Gonzalez
(74) *Attorney, Agent, or Firm* — Staas & Halsey LLP

(57) ABSTRACT

An image forming apparatus is configured to reduce a velocity fluctuation of a rotating body by reducing the AC velocity component of the rotating body. The image forming apparatus may include an image bearing body with a surface on which a toner image is formed; a driving motor configured to drive the image bearing body according to an input signal; and a controller configured to control the driving motor to output a motor output velocity at a period equal to that of an AC velocity component of the image bearing body. A velocity control method for the rotating body includes sampling a continuous motor input signal at a period equal to that of an AC velocity component of a rotating velocity of the rotating body. The sampled signal is transmitted to a driving motor that drives the rotating body, which is driven based upon the discrete motor input signal.

5 Claims, 27 Drawing Sheets

FIG. 21B
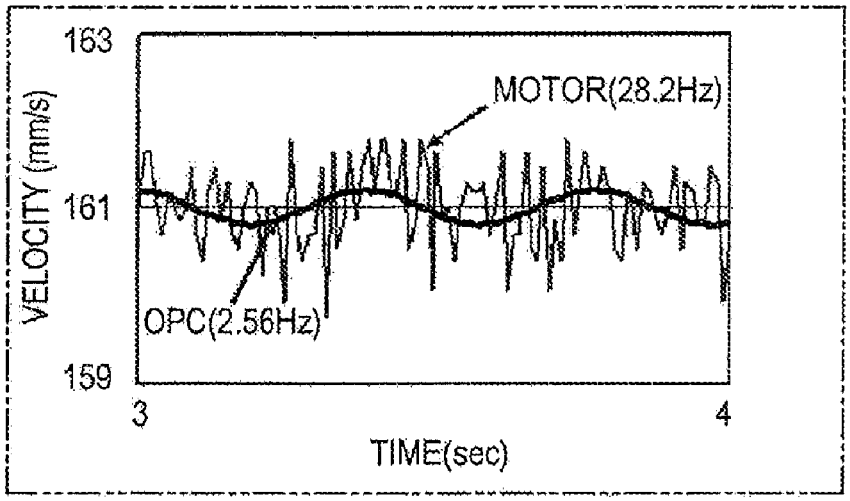
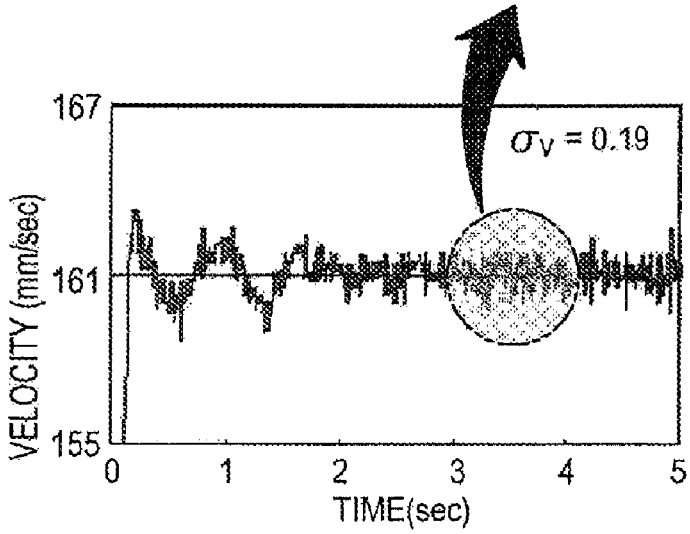
FIG. 21A
FIG. 21C
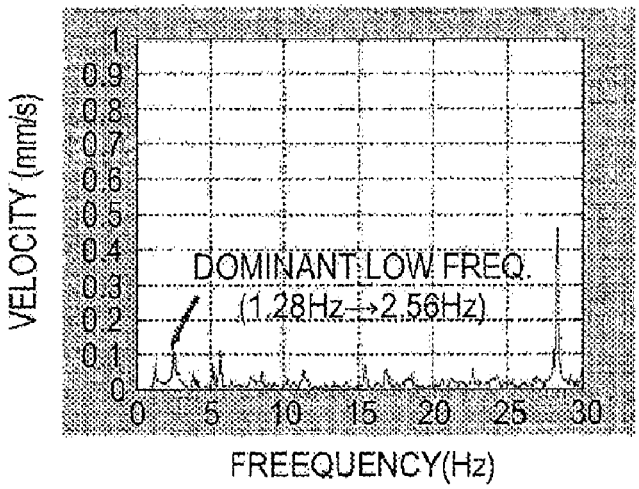

IMAGE FORMING APPARATUS AND VELOCITY CONTROL METHOD OF ROTATING BODY THEREOF

CROSS-REFERENCE TO RELATED APPLICATION

This application claims priority from Korean Patent Application No. 10-2008-0104484, filed on Oct. 23, 2008, in the Korean Intellectual Property Office, the disclosure of which is incorporated herein by reference in its entirety.

TECHNICAL FIELD

The present disclosure relates generally to an image forming apparatus and a velocity control method of a rotating body thereof, and more particularly to an image forming apparatus which reduces a velocity fluctuation of a rotating body and a velocity control method of a rotating body thereof.

BACKGROUND OF RELATED ART

An image forming apparatus may generally operate to form an image on a print medium. Depending on an image forming method, the image forming apparatus may generally be classified as an electrophotographic printer, which forms an image on a print medium through a series of processes, including charging, exposing and developing an electrostatic latent image, and transferring and fusing of the developed image onto a print medium; an inkjet printer, which forms an image by jetting ink through a nozzle; or a thermal transferring printer, which uses a thermal print head.

An image forming apparatus may generally require the use of a rotating body, such as, for example, an image bearing body and a transfer roller, to form an image on a print medium. To secure uniform image quality, the rotating velocity of a rotating body should desirably be kept consistent (i.e., without any fluctuation).

An image forming apparatus may generally include driving power transmitting mechanisms, such as a gear, a belt, a chain, and the like, to transmit rotating power of a rotating shaft of a driving motor to the rotating body. However, unfortunately, even if a driving shaft of the driving motor rotates at a consistent rate, the rotating velocity of the rotating body may fluctuate due to the deviations, due to the allowed fabrication/assembly tolerance, of the power transmitting mechanisms themselves. An image forming apparatus with improved velocity control of the rotating body is thus desired.

SUMMARY OF DISCLOSURE

According to an aspect of the present disclosure, an image forming apparatus may be provided to include an image bearing body, a driving motor and a controller. The image bearing body may have a toner image form on the surface thereof. The driving motor may be configured to drive the image bearing body according to an input signal. The controller may be configured to provide the input signal to control the driving motor so as to cause the driving motor to output a motor output velocity at a period equal to that of an AC velocity component of the image bearing body.

According to an embodiment, the motor output velocity and the AC velocity component of the image bearing body may have a phase difference of approximately 180°.

The controller may supply a discrete motor input signal to the driving motor to output the motor output velocity, in which the discrete motor input signal is generated as an input signal by sampling a continuous motor input signal at predetermined sampling time, which may be, according to an embodiment, 0.05 seconds or less.

The continuous motor input signal may be provided to correspond to a sinusoidal wave that approximates a rotating velocity of the image bearing body having the AC velocity component.

The continuous motor input signal may include a sinusoidal wave which has a phase angle that minimizes an amplitude of the AC velocity component. The phase angle, according to an embodiment, may be 270°. According to an embodiment, the phase angle may differ by the sampling time and/or may increase as the sample time becomes longer.

The image forming apparatus may further include a memory for storing therein the continuous motor input signal and other data and/or information related to the image forming apparatus.

According to another aspect, a method of controlling a velocity of a rotating body of an image forming apparatus may include: sampling a continuous motor input signal at a period equal to an AC velocity component of a rotating velocity of the rotating body to obtain a sampled discrete motor input signal; and providing the sampled discrete motor input signal to a driving motor that drives the rotating body.

Driving the rotating body may include outputting a motor output velocity having a phase difference of approximately 180° with respect to the AC velocity component of the rotating body according to the sampled discrete motor input signal; and rotating the rotating body according to the outputted motor output velocity.

The sampling time may be 0.05 seconds or less, according to an embodiment.

The continuous motor input signal may correspond to a sinusoidal wave that approximates a rotating velocity of the rotating body having the AC velocity component.

The continuous motor input signal may include a sinusoidal wave which has a phase angle minimizing an amplitude of the AC velocity component. The phase angle, according to an embodiment, may be 270°. According to an embodiment, the phase angle may differ by the sampling time.

The method may include reading the continuous motor input signal from a memory component of the image forming apparatus.

According to an embodiment, the method may further include measuring an AC velocity component of the rotating body and generating the continuous motor input signal corresponding to the measured AC velocity component.

According to yet another aspect, a method of controlling a rotating body of an image forming apparatus may comprise: inputting an input control signal to a motor device; and driving the rotating body to rotate at a rotational velocity with the motor device operating according to the input control signal. The input control signal may satisfy the relationship, $Hz=B+Am\cdot\sin(w_m t+\theta_m)$. Hz is the input control signal in pulse per second (PPS). B corresponds to an average number of pulses per second input to achieve a desired rotational velocity of the rotating body. Am proportionally corresponds to an amplitude of fluctuation from the desired rotational velocity of the rotating body. $w_m$ corresponds to an angular velocity of the fluctuation expressed as $2\pi f$, f representing an inverse of a period of the fluctuation. $\theta_m$ represents a phase angle of the input control signal.

The phase angle $\theta_m$ of the input control signal may be empirically determined by selecting an angle that minimizes the amplitude of fluctuation.

The empirical determination of the phase angle may comprise inputting a plurality input control signals each having a respective phase angle different from that of other ones of the input control signals; and selecting as the phase angle a selected angle that produces a standard deviation in the rotational velocity of the rotating body below a threshold value.

The phase angle $\theta_m$ may range between 210° and 320°.

BRIEF DESCRIPTION OF THE DRAWINGS

Various features and advantages of the disclosure will become more apparent by the following detailed description of several embodiments thereof with reference to the attached drawings, of which:

FIG. 21A is a graph illustrating a rotating velocity of an image bearing body if the velocity is controlled in a constant velocity control mode, according to an embodiment;

FIG. 21B is a graph which locally enlarges the graph of the rotating velocity in FIG. 21A;

FIG. 21C is a graph illustrating a frequency analysis of a rotating velocity, according to an embodiment;

DETAILED DESCRIPTION OF SEVERAL EMBODIMENT

Figure 1:
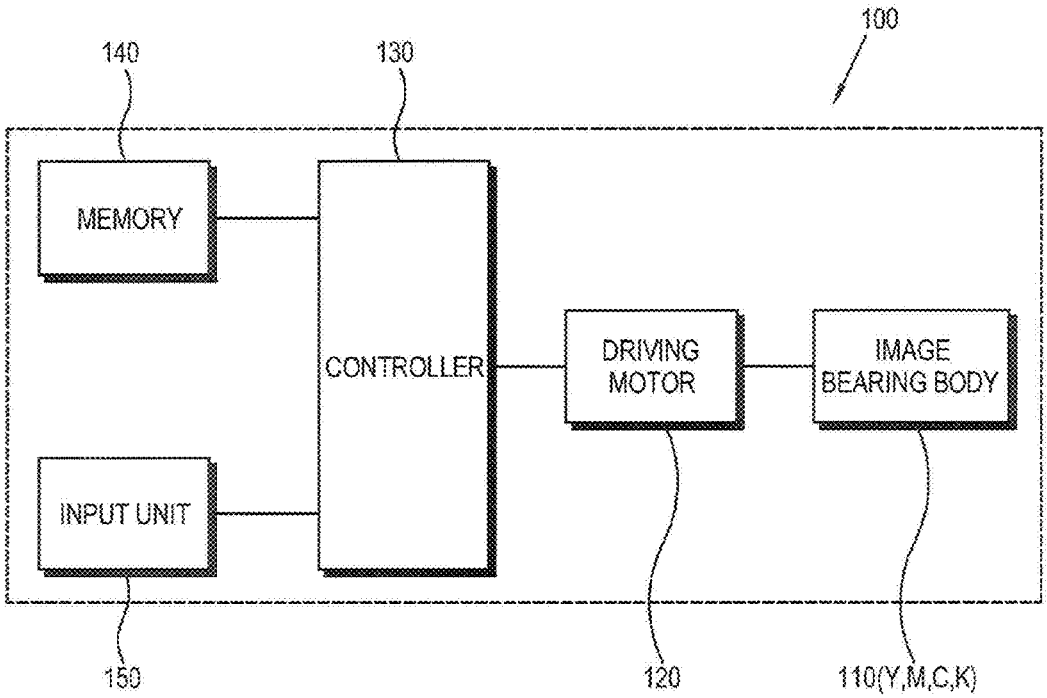
FIG. 1 is a block diagram of an image forming apparatus according to an embodiment.

Reference will now be made in detail to several embodiment, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

With reference to FIG. 1, an image forming apparatus 100 may include an image bearing body 110 as an example of a rotating body; a driving motor 120 configured to drive the image bearing body 110; and a controller 130 configured to control the driving motor 120. The image forming apparatus 100 may further include a memory component 140 for storing a continuous motor input signal. Other data and/or information may be stored in the memory component. An input unit 150 may also be included as part of the image forming apparatus 100. The input unit 150 may allow for user input related to operation of the image forming apparatus 100, according to an embodiment.

The driving motor 120 may include a driving shaft (not shown) configured to rotate according to a motor input signal supplied by the controller 130, and a pinion (not shown) connected to the driving shaft in the same axis. The driving motor 120 may include a brushless direct-current (BLCD) motor, for example.

If the image forming apparatus 100 includes multiple image bearing bodies 110, the driving motor 120 may include a plurality of driving motors 120 to correspond to the plurality of image bearing bodies 110 to drive each of the plurality of image bearing bodies 110.

A gear (not shown) may be installed in a rotating shaft (not shown) of the image bearing body 110 to receive driving power from the pinion of the driving motor 120. Driving power transmitting parts such as a coupler, a chain, a belt, and the like may be provided to transmit the driving power of the pinion to the image bearing body 110.

A visible image including developer, e.g., toner, may be formed on the surface of the image bearing body 110. Broadly speaking, and by way of an example, the visible developer image may be formed by uniformly charging the surface of the image bearing body 110, which surface may be exposed to a light corresponding to a desired image by an exposing unit (not shown) to create potential differences defining an electrostatic latent image across the surface of the image bearing body. The electrostatic latent image is then developed with developer, such as, for example, toner particles, to form the visual developer image on the surface of the image bearing body 110.

The image bearing body 110 may include a plurality of photo conductors for forming different colored developer images, for example, in yellow, magenta, cyan and black (YMCK). Forming a color image with the plurality of image bearing bodies 110 may be accomplished by utilizing a so-called a tandem type or a single path type process. In some cases, however, the image bearing body 110 may include a single photo conductor. An intermediate transfer belt unit (not shown) may be provided to face the single image bearing body 110 to form a color image. Each time an intermediate transfer belt (not shown) rotates a complete loop, a visible image in one color that had been formed on the surface of the image bearing body 110 is transferred to the belt. Accordingly, in four rotations of the belt, four color images of YMCK are transferred to the belt overlapping one another to form a color image. Such a method is generally referred to as a multi-path type.

According to an embodiment, the controller 130 may operate in a general control mode to control the driving motor 120 to rotate a driving shaft (not shown) of the driving motor 120 at consistent RPM and/or a constant velocity control mode to control the driving motor 120 to output a motor output velocity at a period equal to that of an AC velocity component, thereby reducing the AC velocity component of the image bearing body 110.

A mode conversion between the general control mode and the constant velocity control mode may be performed manually at a user's request or automatically if, for example, a color registration of a color image formed on a print medium by the image bearing body 110 is determined to be poor or to not meet certain requirements.

Figure 2:
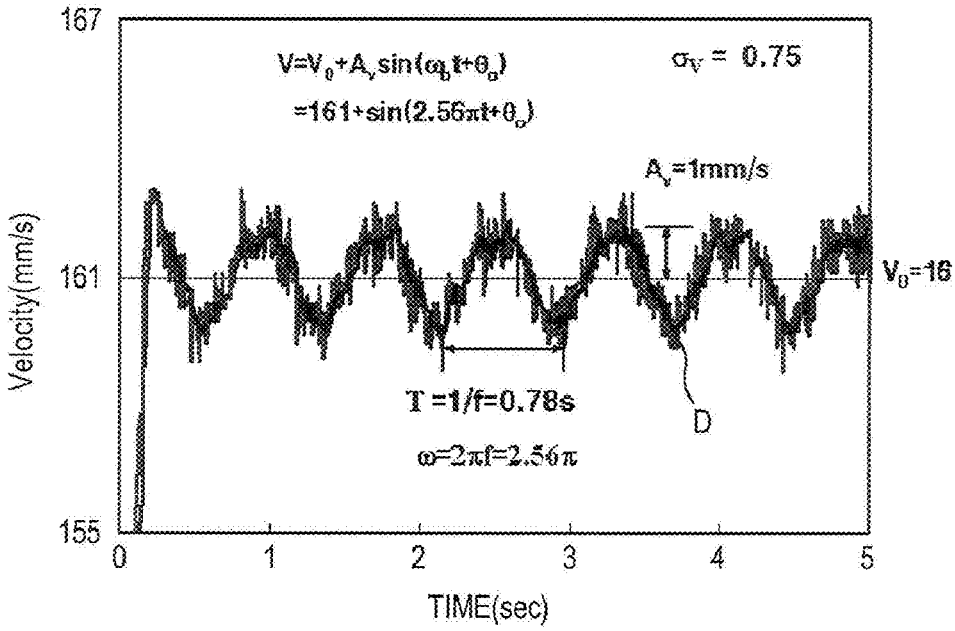
FIG. 2 illustrates a velocity profile of an image bearing body of the image forming apparatus in FIG. 1, according to an embodiment.
Figure 3:
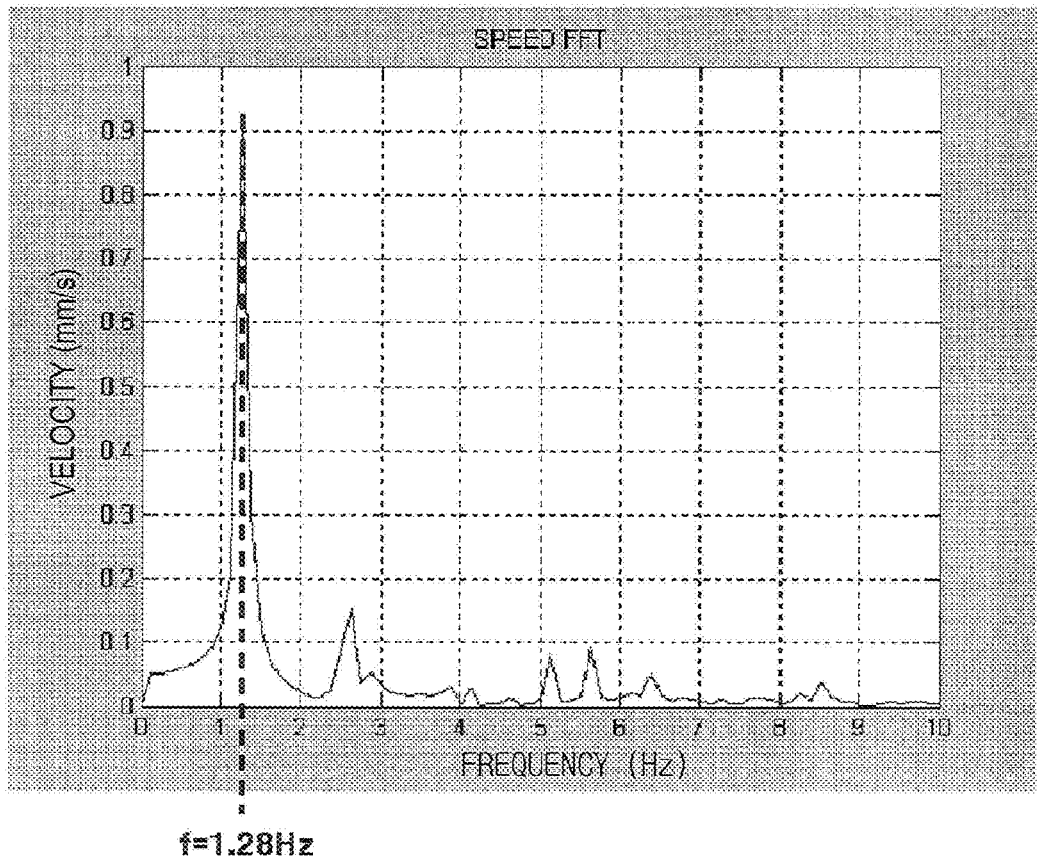
FIG. 3 is a graph illustrating a frequency analysis of velocity of an image bearing body, according to an embodiment.

FIG. 2 is a graph illustrating a rotating velocity of the image bearing body 110 as a function of time when the driving motor 120 is operating in the general control mode. FIG. 3 is a graph illustrating a frequency analysis of the rotating velocity of the image bearing body 110. In this example, the image bearing body 110 refers to an image bearing body applied with color developer, e.g., magenta developer.

In the plots shown in FIGS. 2 and 3, for the image bearing body 110 to have a rotating velocity of 161 mm/sec, a motor input signal of 1268.4 PPS (pulse per second) is input at a sampling time of 0.01 seconds to the driving motor 120.

As shown in FIG. 2, the rotating velocity of the image bearing body 110 has an average velocity component of 161 mm/sec and an AC velocity component D with an amplitude Av of approximately 1 mm/sec and a period T of 0.78 second. As shown in FIG. 3, a frequency of 1.28 Hz is the most dominant frequency.

Thus, when the driving shaft of the driving motor 120 is controlled in the general control mode to rotate at consistent RPM, a velocity fluctuation, such as the AC velocity component D, is incorporated in the rotating velocity of the image bearing body 110.

The AC velocity component D may be approximated by a sinusoidal wave, and accordingly the rotating velocity V of the image bearing body 110, as shown in FIG. 2, may be approximated by formula (1) shown below.

$$V=V_0+A\nu \sin(w_0 t+\theta_0) \qquad \text{Formula (1)}$$

According to this example, the DC component of the rotating velocity of the image bearing body 110 $V_0$=161 mm/sec;

$A\nu$=1 mm/sec;

$w_0=2\pi f=2.567\pi$ (f=1/T=1/0.78=1.28 Hz); and $\theta_0$=Phase of the AC velocity component D As shown in FIG. 2, the AC velocity component D is present in the rotating velocity of the image bearing body 110 in the general control mode. This may result from, for example, a manufacturing tolerance of components, such as, for example, a gear, pinion, etc., of the driving motor 120 or of the mechanism for delivering the a driving power from the driving motor 120 to the image bearing body 110. Other factors may also contribute to the presence of the AC velocity component D in the rotating velocity.

Figure 4:
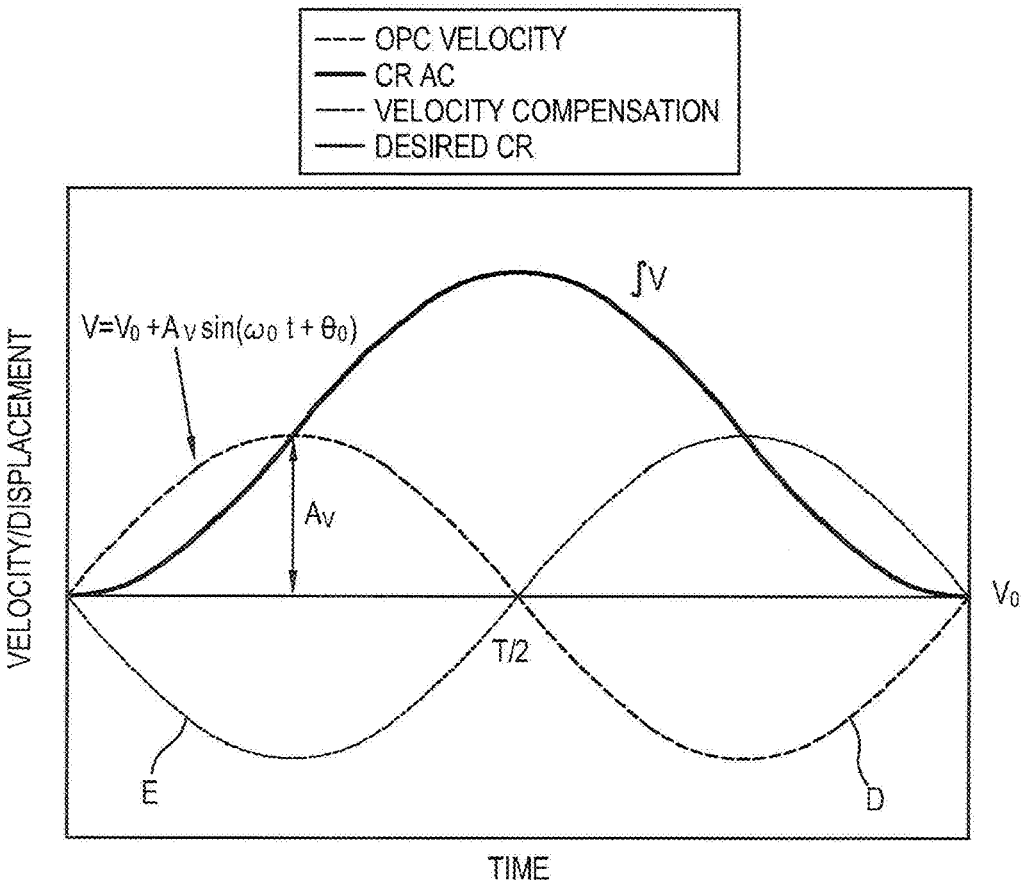
FIG. 4 is a graph illustrating a correlation between an AC velocity component of a rotating velocity of an image bearing body and color registration, according to an embodiment.
Figure 5:
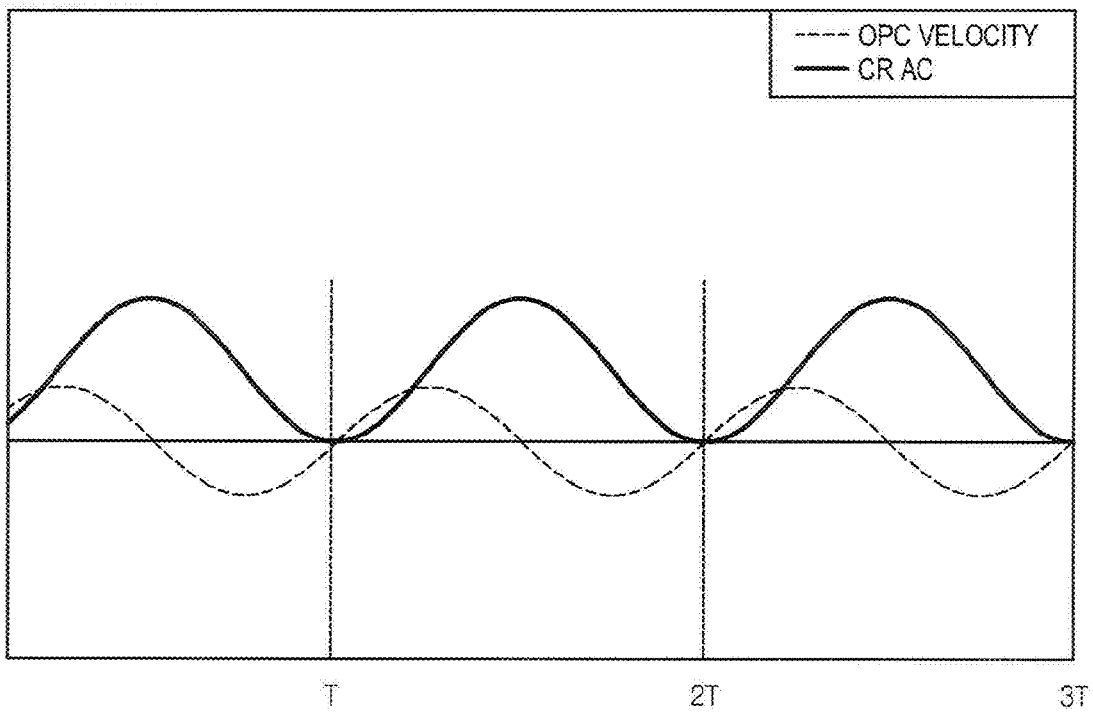
FIG. 5 is a graph extending the graph in FIG. 4 with respect to a time axis.

FIG. 4 is a graph illustrating an effect of the AC velocity component D of the image bearing body 110 on color registration. The "OPC velocity" graph in FIG. 4 refers to the formula (1) approximation of the AC velocity component D as a sinusoidal wave, while the "CR AC" graph refers to an error of color registration due to the AC velocity component D of the image bearing body 110. FIG. 5 is a graph which extends the "OPC velocity" and "CR AC" graphs in FIG. 4 across a longer time axis. The period of the foregoing two graphs is T.

The error of color registration refers to an error between a target location of dots of the developer and the actual location of the dots. The smaller the error of color registration, the better and clearer the color registration and the resulting color images become. The location error of the color registration is largest at the time of a semi-period T/2 of the AC velocity component D, as illustrated in FIGS. 4 and 5.

If the AC velocity component D of the image bearing body 110 is compensated for by the "velocity compensation" graph E, shown in FIG. 4, the AC velocity component D of the image bearing body 110 may be compensated for completely or near completely. Accordingly, the error of the color registration may be zero or near zero, as illustrated in the "Desired CR" graph shown in FIG. 4.

In the constant velocity control mode of the controller 130, a motor input signal is generated according to the following formula (2), and is provided to the driving motor 120 to compensate for the rotating velocity of the image bearing body 110, as in the "velocity compensation" graph E in FIG. 4.

$$\text{Motor input signal, Hz}=B+Am \sin(w_m t+\theta_m) \qquad \text{Formula (2)}$$

In the general control mode a value B (1268.4 PPS) is provided as a motor input signal, while in the constant velocity control mode, a fluctuation component of a sinusoidal waveform is included as well as the value B as the motor input signal.

In Formula (2) above:

B=Average PPS of motor input signal corresponding to $V_0$ in the formula (1);

$A_m$=Amplitude of fluctuation component of motor input signal corresponding to Av in formula (1);

$w_m$=Angular velocity of the motor input signal, which is the same as the angular velocity $w_0$ in the formula (1) (e.g., $w_m=w_0$); and $\theta_m$=Phase angle of the motor input signal (empirically determinable);

Thus, when B is 1268.4 PPS, the average PPS for a linear velocity of $V_0$=161 mm/sec.

As shown in FIG. 4, Am is calculated by a following proportional formula since it may be assumed that the amplitude of the fluctuation component of the motor input signal Hz in the formula (2) corresponds thereto to compensate for the AC velocity component D of the image bearing body 110.

$$161\ \text{mm/sec}:1268.4\ \text{PPS}=1\ \text{mm/sec}(Av):Am \qquad \text{Formula (3)}$$

Accordingly, Am is 7.9 PPS in this example.

Figure 6A:
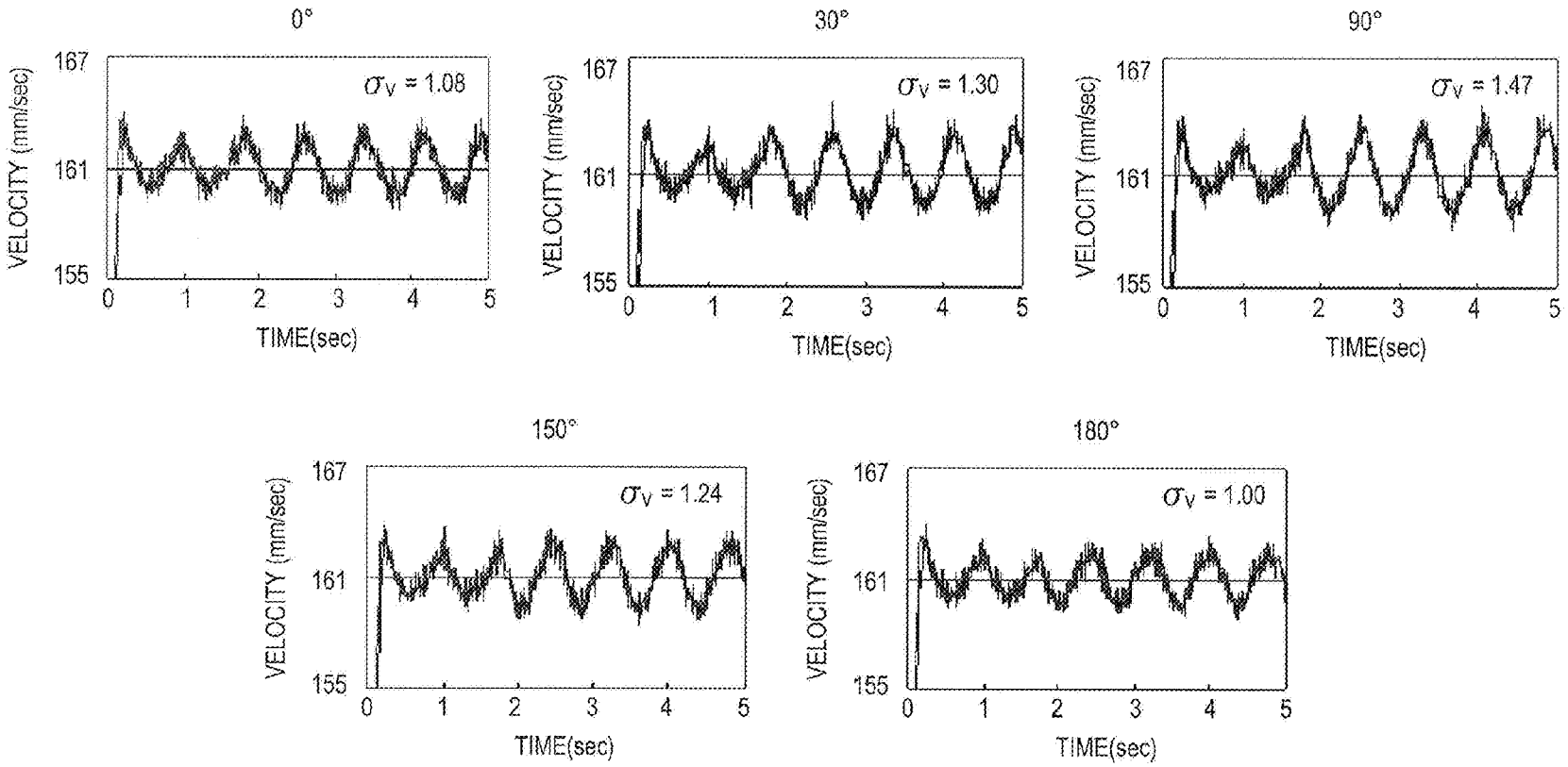
FIGS. 6A through 6C illustrate a test result of the rotating velocity of an image bearing body depending on a change in phase angles of a motor input single, according to an embodiment.
Figure 6B:
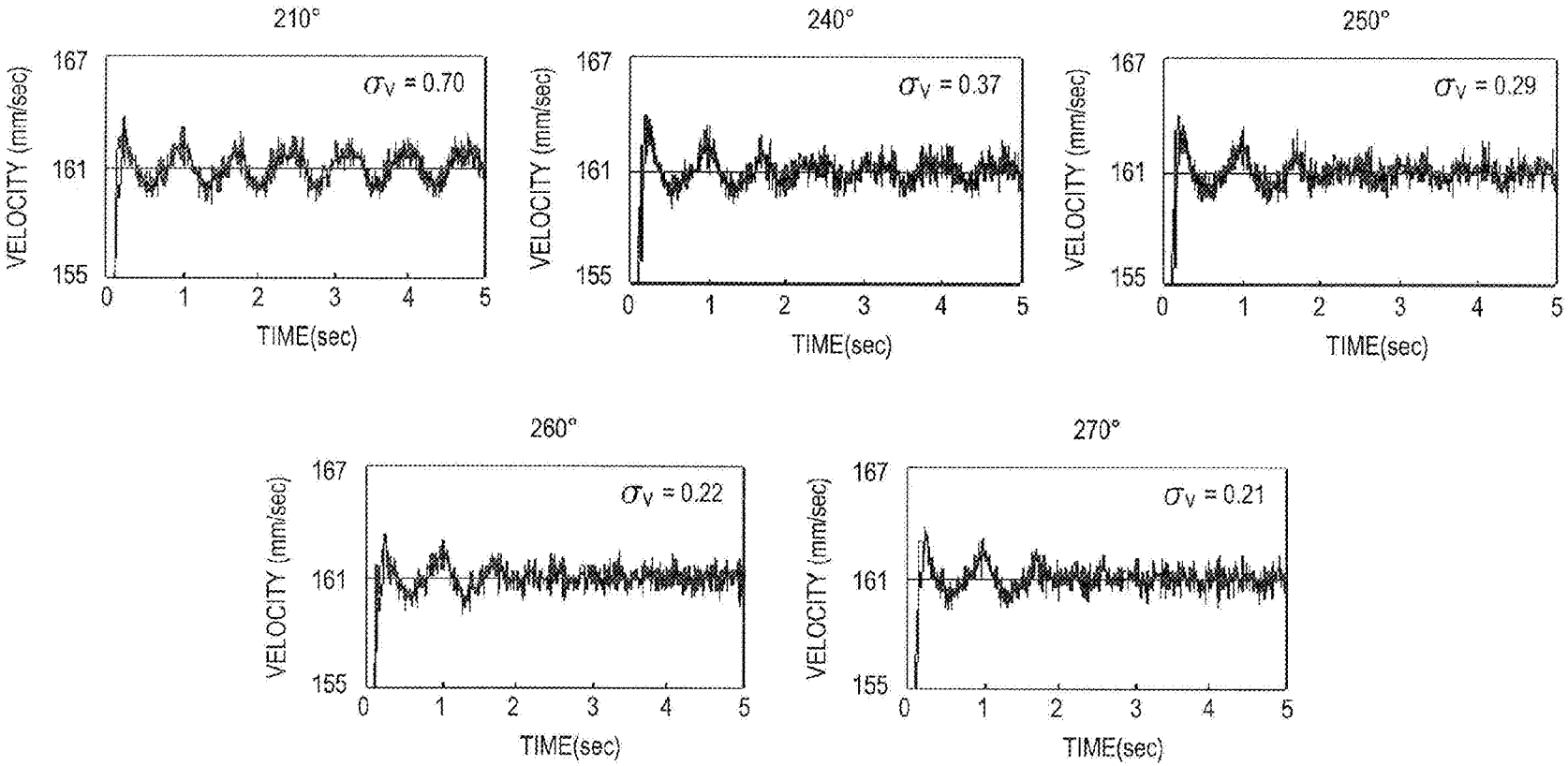
Figure 6C:
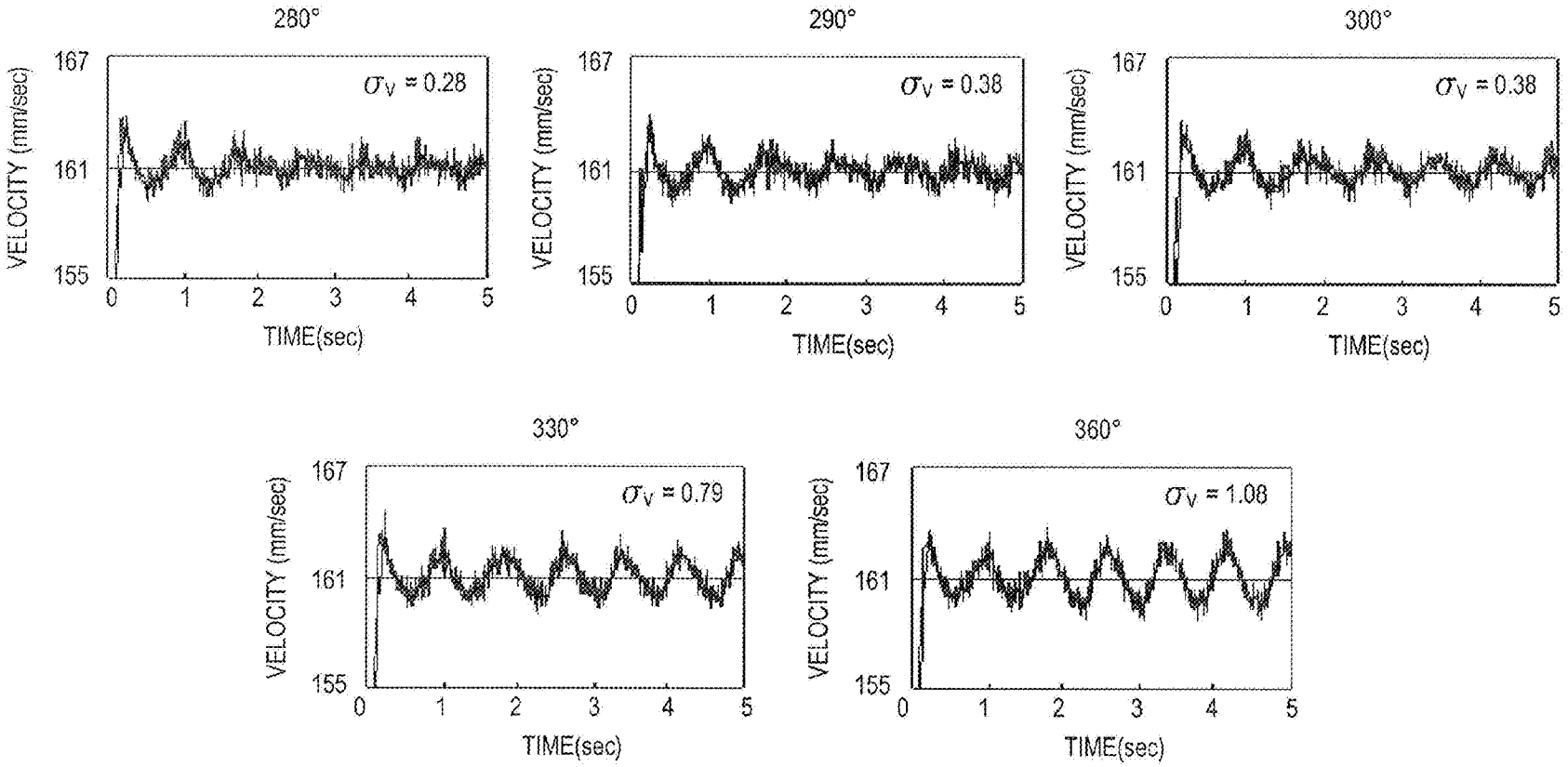

With the phase angle $\theta_m$ as a test variable, the test result of the change in the AC velocity component of the image bearing body 110 is illustrated in FIGS. 6A through 6C with $\theta_m$ changing from zero degree to 360°.

FIGS. 6A through 6C are graphs illustrating the rotating velocity of the image bearing body 110 as a function of time if the phase angle $\theta_m$ as the motor input signal input to the driving motor 120, in accordance with the formula (2), is 0°, 30°, 90°, 150°, 180°, 210°, 240°, 250°, 260°, 270°, 280°, 290°, 300°, 330° and 360°.

In this example, if the phase angle $\theta_m$ is 270°, the standard deviation $\sigma_v$ is 0.21. At this phase angle $\theta_m$, the AC velocity component D of the image bearing body 110 is at a minimum. Thus, to minimize the AC velocity component D of the magenta image bearing body 110, a motor input signal (motor input velocity) which satisfies the following formula (4) is applied to the driving motor 120.

$$\text{Motor input signal}=1268.4+7.9\sin(2.56\pi+270°)(\text{PPS}) \qquad \text{Formula (4)}$$

Similar to the formula (3), the motor input signal includes a fluctuation component Am $\sin(w_m t+\theta_m)$ to offset the AC velocity component D of the image bearing body 110.

The period (angular velocity) of the fluctuation component included in the motor input signal is the same as the period (angular velocity) of the AC velocity component D of the image bearing body 110.

The motor output velocity (angular velocity, RPM) output by the driving motor 120 according to the motor input signal also fluctuates at the same period as that of the AC velocity component D.

Figure 7:
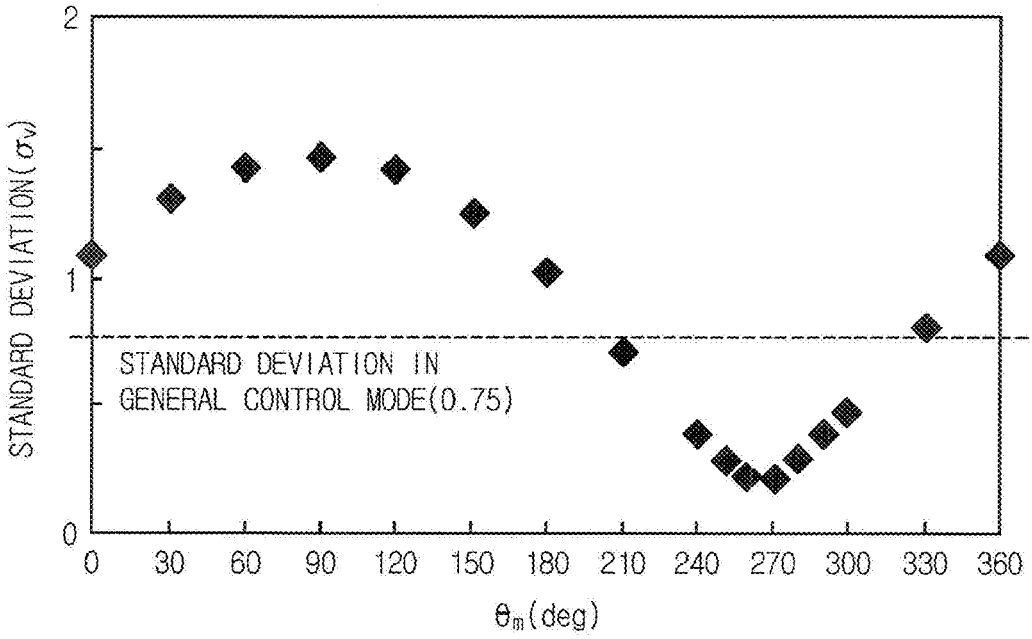
FIG. 7 illustrates a change in a standard deviation $\sigma_v$ of an AC velocity component D of an image bearing body depending on the change in phase angles $\theta_m$ of a motor input signal, according to an embodiment.

FIG. 7 illustrates how the standard deviation $\sigma_v$ of the AC velocity component D of the image bearing body 110 changes as a function of change in the phase angle $\theta_m$ of the motor input signal according to the test results in FIG. 6A through 6C. The standard deviation $\sigma_v$ implies a large amplitude Av of the AC velocity component D of the image bearing body 110. Thus, the larger the standard deviation $\sigma_v$, the worse color registration becomes.

As illustrated in FIG. 2, the standard deviation of the AC velocity component D of the image bearing body 110 is 0.75 mm/sec in the general control mode with the consistent motor input signal.

As illustrated in FIG. 7, when the phase angle $\theta_m$ of the motor input signal is 90°, the standard deviation $\sigma_v$ is the largest (i.e., 1.47 mm/sec). This approximately doubles the standard deviation in the general control mode (i.e., 0.75 mm/sec). The phase angle $\theta_0$ at the approximated rotating velocity V of the image bearing body 110 in the formula (1) is approximately 90°. Accordingly, when the phase angle $\theta_m$ of the motor input signal is 90°, the AC velocity component D of the image bearing body 110 and the fluctuation component of the motor input signal, which are desired to offset each other, have the same phase. The AC velocity component D may therefore be seen as reinforced rather than offset.

If the phase angle $\theta_m$ of the motor input signal is 270°, a phase difference between the AC velocity component D of the image bearing body 110 and the fluctuation component of the motor input signal is 180°. The two components may thus offset each other.

For example, in the illustrated example, it can be observed that, when a phase difference of 180°, exists between the phase angle $\theta_m$ of the motor input signal and the phase angle $\theta_0$ of the AC velocity component D of the image bearing body 110, the standard deviation is at its smallest.

As shown in FIG. 7, even if the phase difference of 180° does not exist between the phase angle $\theta_m$ of the motor input signal and the phase angle $\theta_0$ of the AC velocity component D of the image bearing body, the standard deviation is smaller than in the general control mode in the case when the phase angle $\theta_m$ of the motor input signal is approximately in the range of 210° and 320°. If this is calculated as the phase difference, it ranges from approximately 130° (210°−90°) to 230° (320°−90°.

That is, if the motor input signal is provided to the driving motor 120 to make the phase difference between the phase angle $\theta_m$ of the motor input signal and the phase angle $\theta_0$ of the AC velocity component D of the image bearing body 110 exist in the range of approximately 130° to 230°, the standard deviation of the AC velocity component D of the image bearing body 110 is smaller than in the general control mode.

Figure 8A:
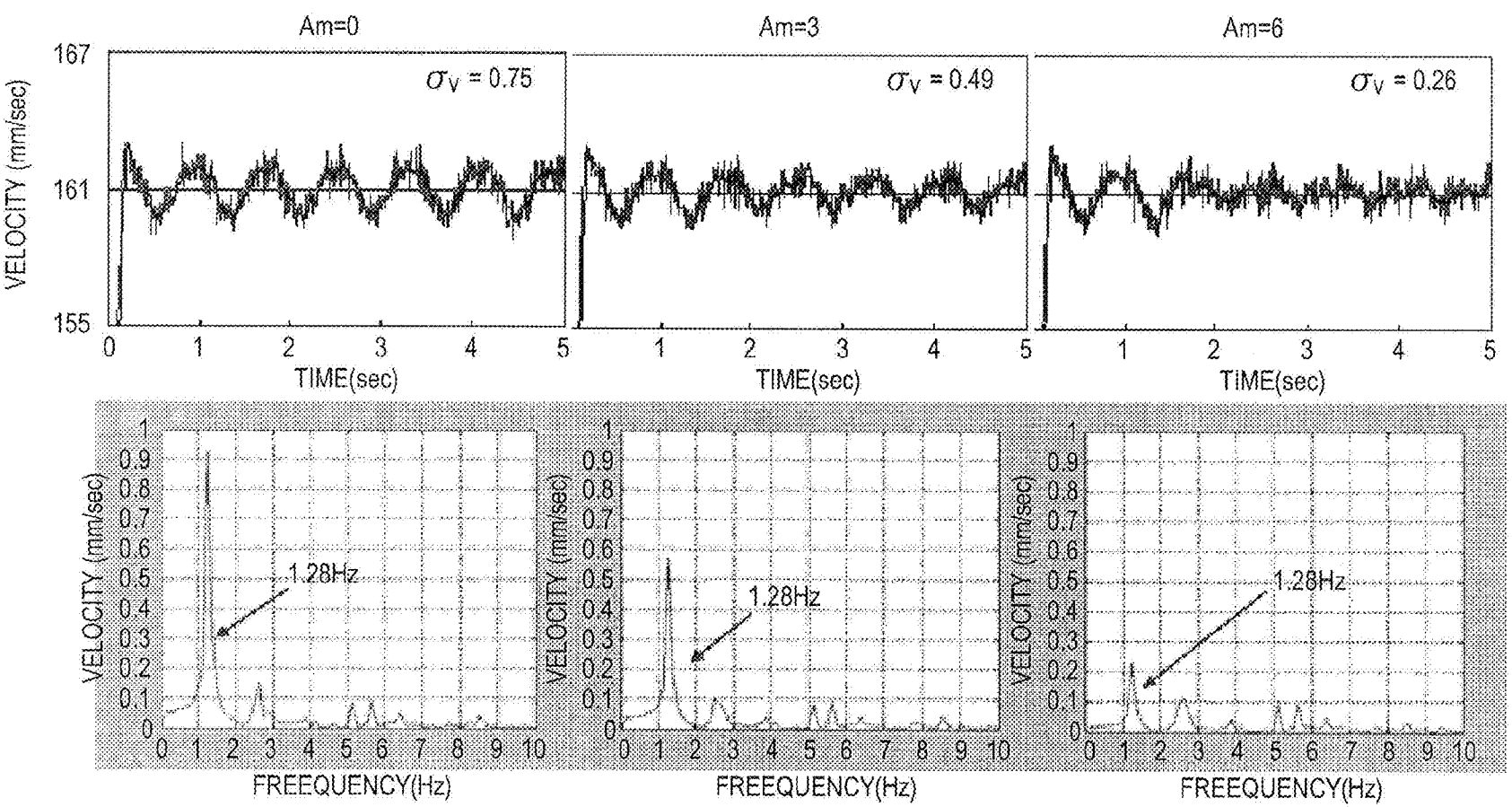
FIGS. 8A and 8B are graphs illustrating a rotating velocity of an image bearing body outputted according to time for various amplitudes Am of a fluctuation component with a constant phase angle $\theta_m$ of a motor input signal, according to an embodiment.
Figure 8B:
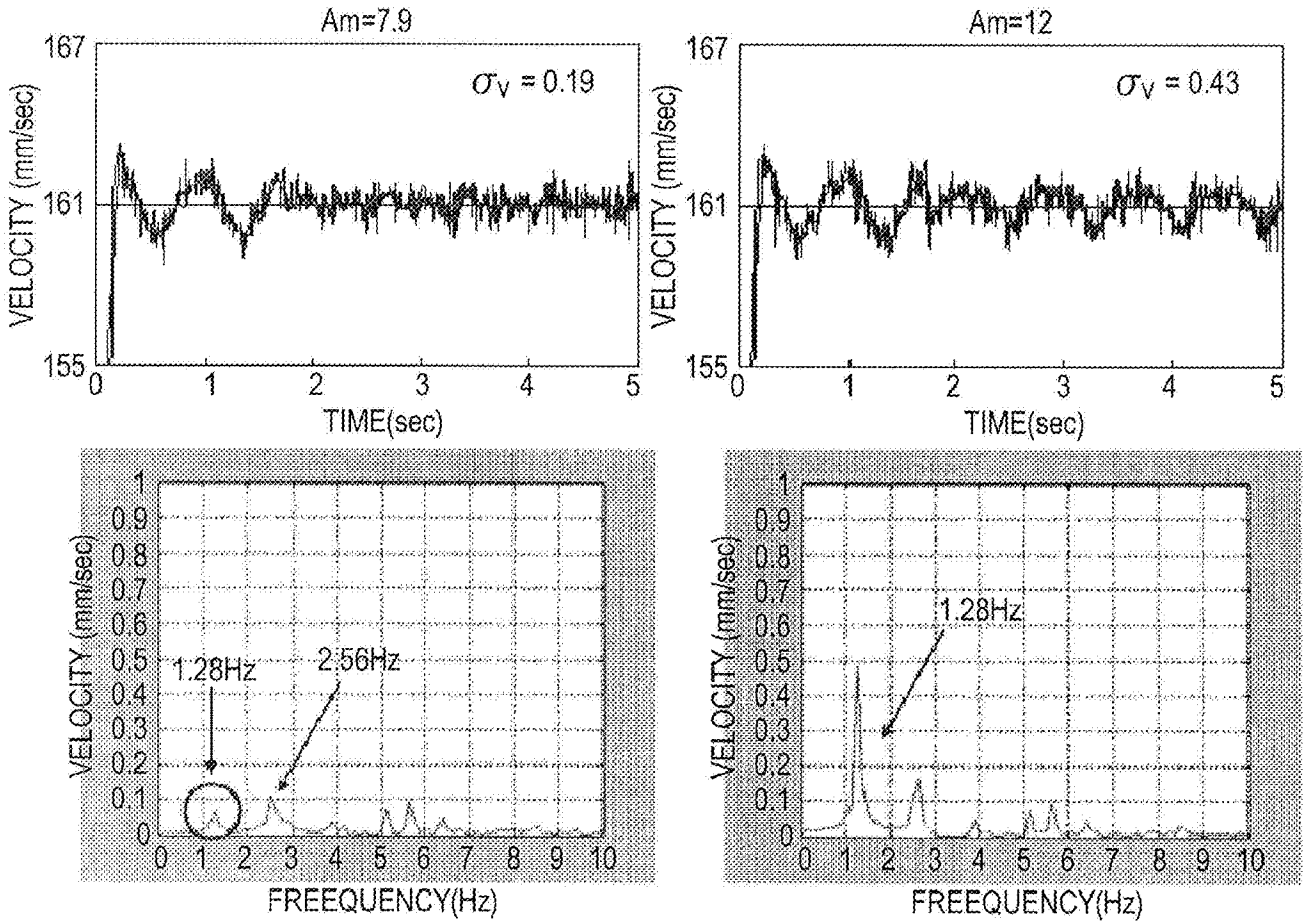

FIGS. 8A and 8B are graphs illustrating the rotating velocity of the image bearing body 110 as a function of time if the amplitude Am of the fluctuation component in the formula (3) is changed to 0, 3, 6, 7.9 and 12 (PPS), respectively, while the phase angle $\theta_m$ of the motor input signal in the formula (3) is fixed at 270°. Additionally, a graph of frequency analysis is illustrated with each amplitude.

Figure 9:
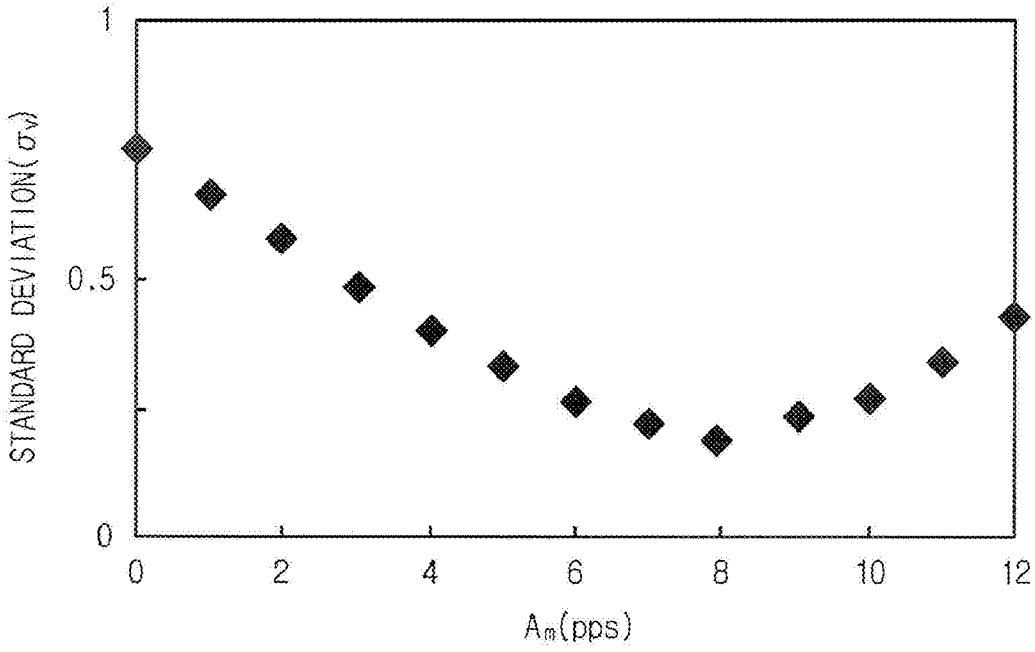
FIG. 9 is a graph illustrating a standard deviation $\sigma_v$ of a rotating velocity of an image bearing body with respect to the amplitude Am of a fluctuation component, according to an embodiment.

FIG. 9 is a graph illustrating a standard deviation $\sigma_v$ of the rotating velocity of the image bearing body 110 with respect to the amplitude Am of the fluctuation component in the formula (3) according to the test result shown in FIG. 8.

As shown in FIGS. 8A to 9, if the amplitude is 7.9 PPS, as in the fluctuation component of the motor input signal assumed in the formula (4), the standard deviation $\sigma_v$ of the rotating velocity of the image bearing body 110 is at its smallest, 0.19 mm/sec.

As illustrated in the graph of frequency analysis, if the amplitude Am of the fluctuation component is 7.9 PPS, a dominant low frequency rises from 1.28 Hz to 2.56 Hz. In the remaining cases, the dominant low frequency remains at 1.28 Hz. The change in the dominant low frequency may positively contribute to an impact on the aspect of error of color registration.

Figure 10:
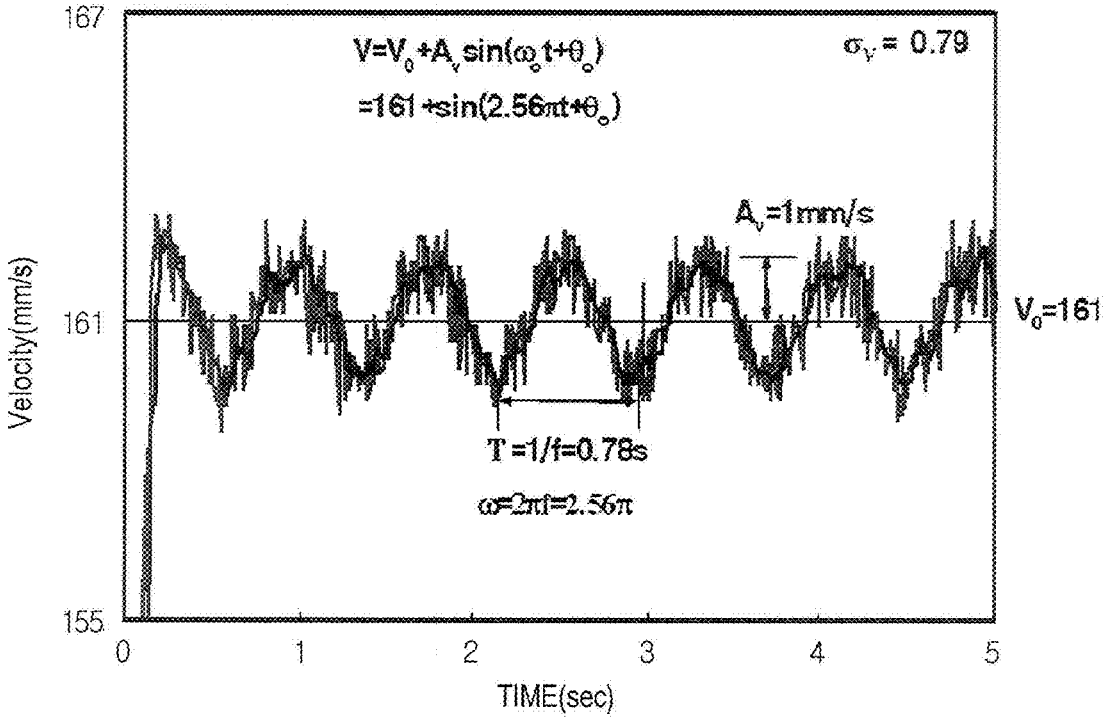
FIG. 10 is a graph illustrating a rotating velocity of an image bearing body according to measured time, according to an embodiment.
Figure 11:
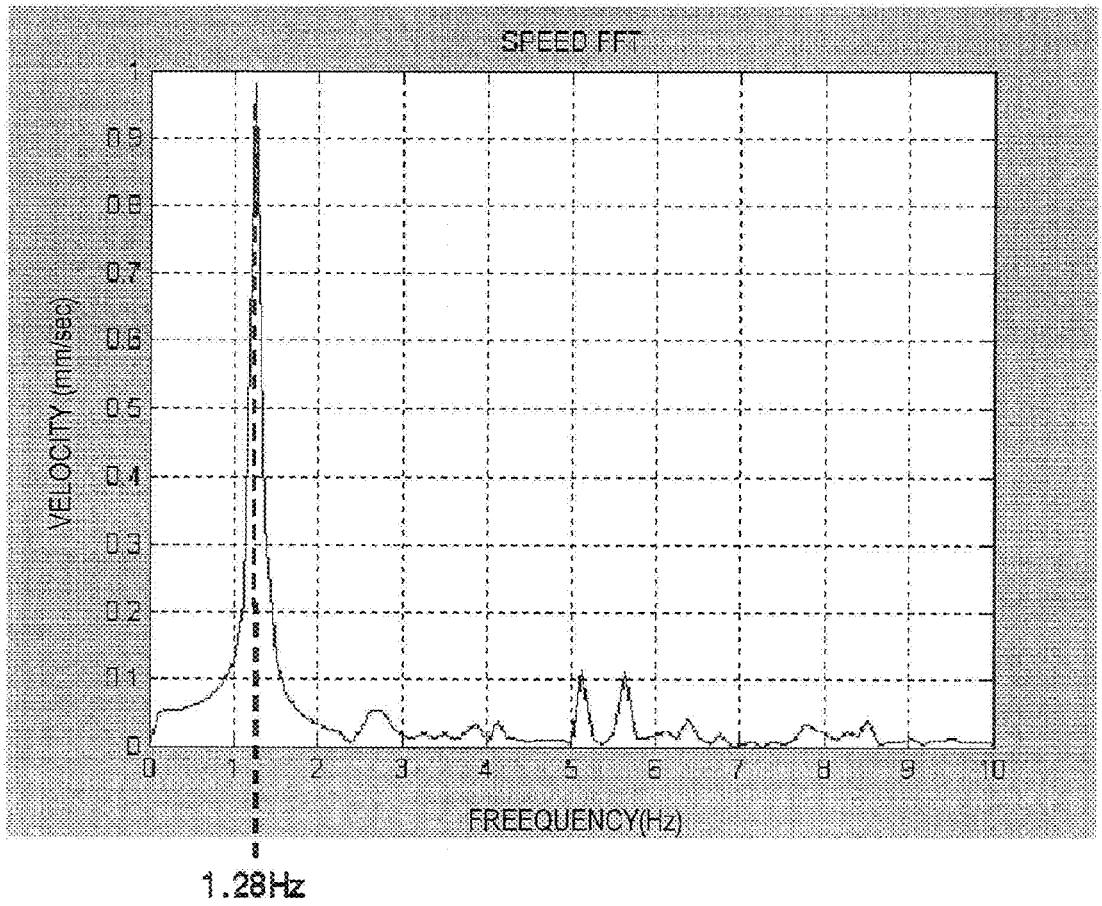
FIG. 11 is a graph illustrating frequency analysis of a rotating velocity of an image bearing body, according to an embodiment.

FIG. 10 is a graph which illustrates a rotating velocity of a cyan image bearing body 110 as a function of measured time if a motor input signal of 1268.4 PPS is provided to the driving motor 120 at a sampling time of 0.01 second in the general control mode, according to an embodiment. FIG. 11 is a graph illustrating a frequency analysis during a test in FIG. 10.

If the driving power transmitting unit from the driving motor 120 to the cyan image bearing body 110 is the same as that from the driving motor 120 to the magenta image bearing body 110, a pattern of the rotating velocity may be the same or nearly the same. The standard deviation of the rotating velocity of the cyan image bearing body 110 in this case is 0.79 mm/sec, which is slightly larger than 0.75 mm/sec, the standard deviation of the rotating velocity of the magenta image bearing body 110 shown in FIG. 2.

As shown in FIG. 10, the rotating velocity V of the cyan image bearing body 110 may be approximated by the formula (1) above. As shown in FIG. 11, the most dominant low frequency is the same as that of the foregoing example of the magenta image bearing body 110, (i.e., 1.28 Hz).

Figure 12:
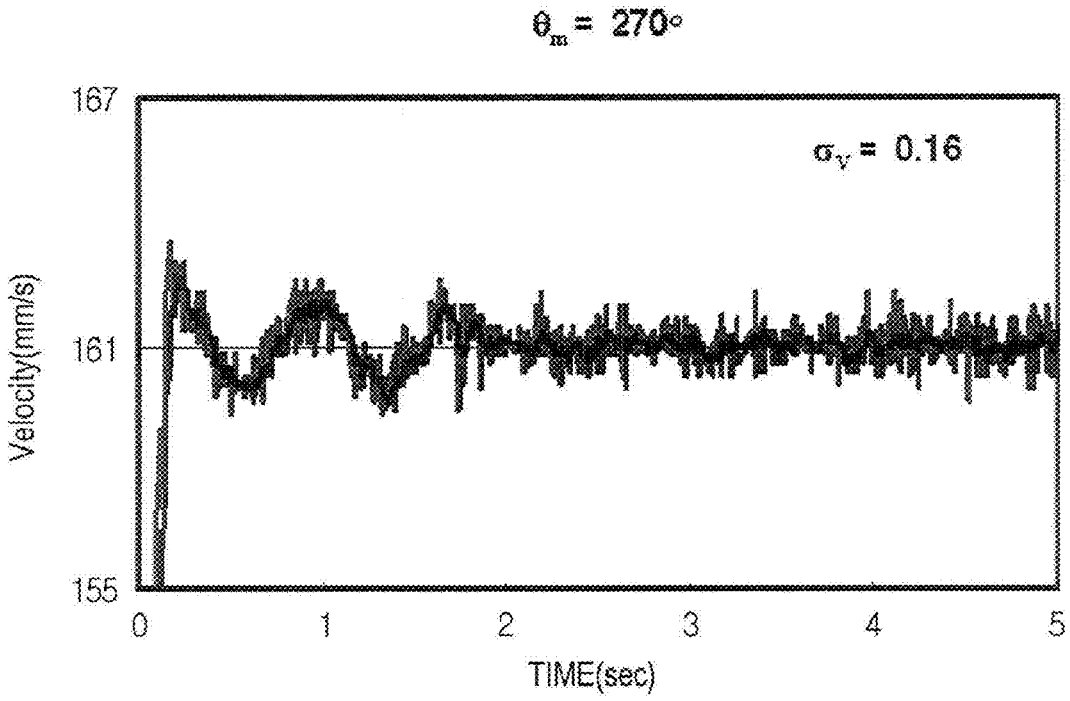
FIG. 12 is a graph illustrating a rotating velocity of an image bearing body according to a motor input signal provided to a driving motor, according to an embodiment.
Figure 13:
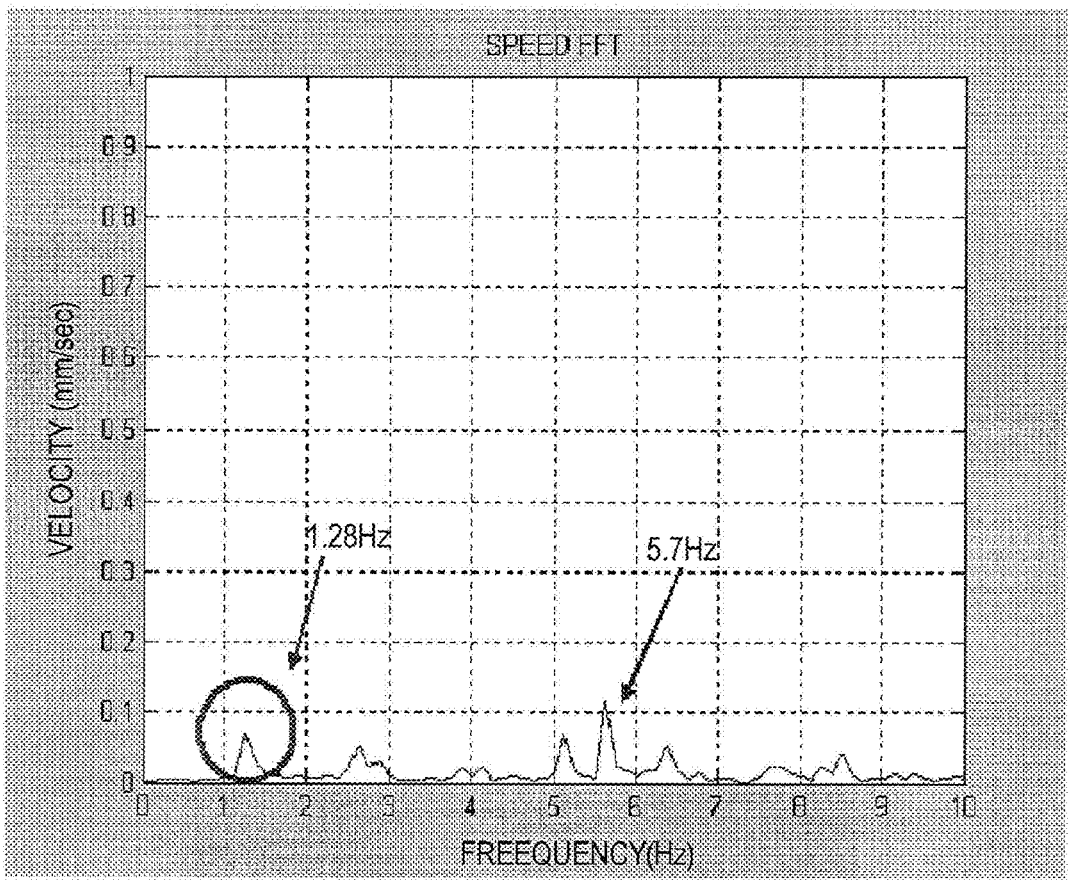
FIG. 13 is a graph illustrating a frequency analysis of a rotating velocity of an image bearing body, according to an embodiment.
Figure 14:
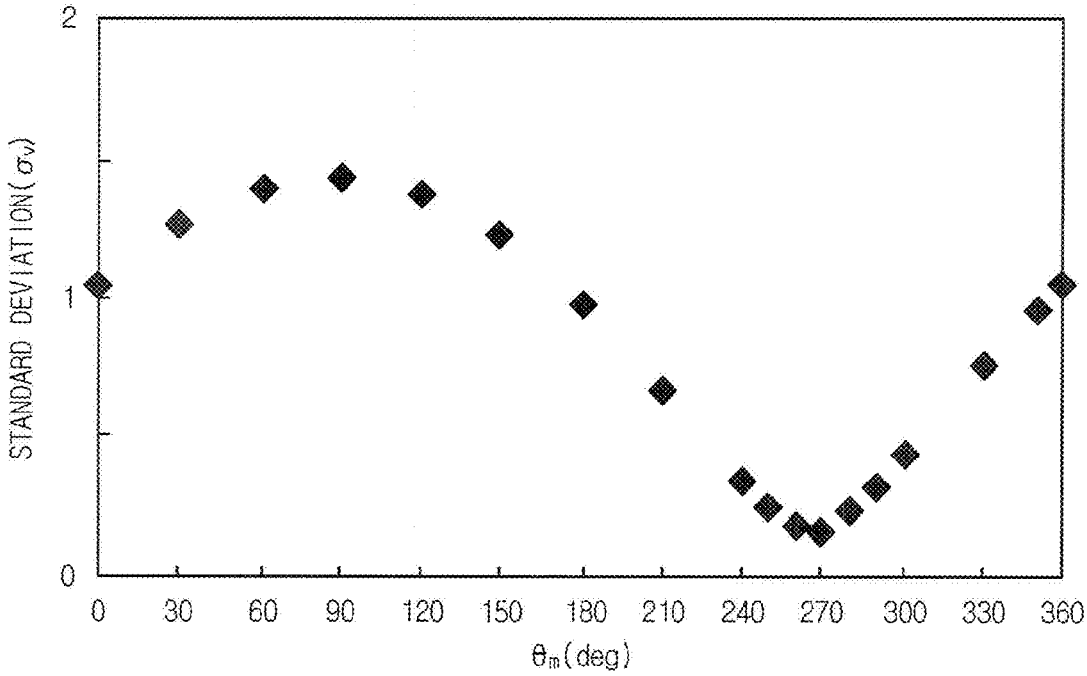
FIG. 14 is a graph illustrating changes in a standard deviation $\sigma_v$ of an AC velocity component of an image bearing body depending on a change in a phase angle Θm of a motor input signal, according to an embodiment.

If a motor input signal in the formula (4) is provided to the driving motor 120 to offset the AC velocity component D of the cyan image bearing body 110 shown in FIG. 10, the test result as in FIGS. 12 to 14 may be obtained.

FIG. 12 is a graph illustrating a rotating velocity of the cyan image bearing body 110 as a function of time. It may be noted that the AC velocity component D is considerably smaller than that in FIG. 10.

In the general control mode, the standard deviation $\sigma_v$ of the rotating velocity of the cyan image bearing body 110 is 0.79 mm/sec, as shown in FIG. 10. In the constant velocity control mode where a motor input signal including a fluctuation component, as in the formula (4) according to an embodiment, is provided to the driving motor 120, the standard deviation $\sigma_v$ of the rotating velocity of the cyan image bearing body 110 is 0.16 mm/sec, as shown in FIG. 12. That is, the standard deviation $\sigma_v$ is reduced by approximately 80%.

As illustrated in FIG. 13, a dominant low frequency increases to 5.7 Hz from 1.28 Hz. Such increased dominant low frequency may have a positive impact on color registration.

As illustrated in FIG. 14, if the phase angle $\theta_m$ of the motor input signal is in the range of 210° to 330°, the standard deviation is smaller than that in the general control mode. If this is calculated as the phase difference, it ranges from approximately 130° (210°−90°) to 240° (340°−90°. This is similar to the graph showing the change in the standard deviation according to the phase angle $\theta_m$ in the magenta image bearing body 110 with reference to FIG. 7.

Since the motor input signal in the formulas (3) and (4) is a continuous, analog input signal as a function of time, it may be, according to an embodiment, sampled to be a discrete, digital input signal to be provided to the driving motor 120. For example, the test results in FIGS. 2 to 14 demonstrate continuous motor input signals sampled by a sampling time Ts of 0.01 second.

Figure 15:
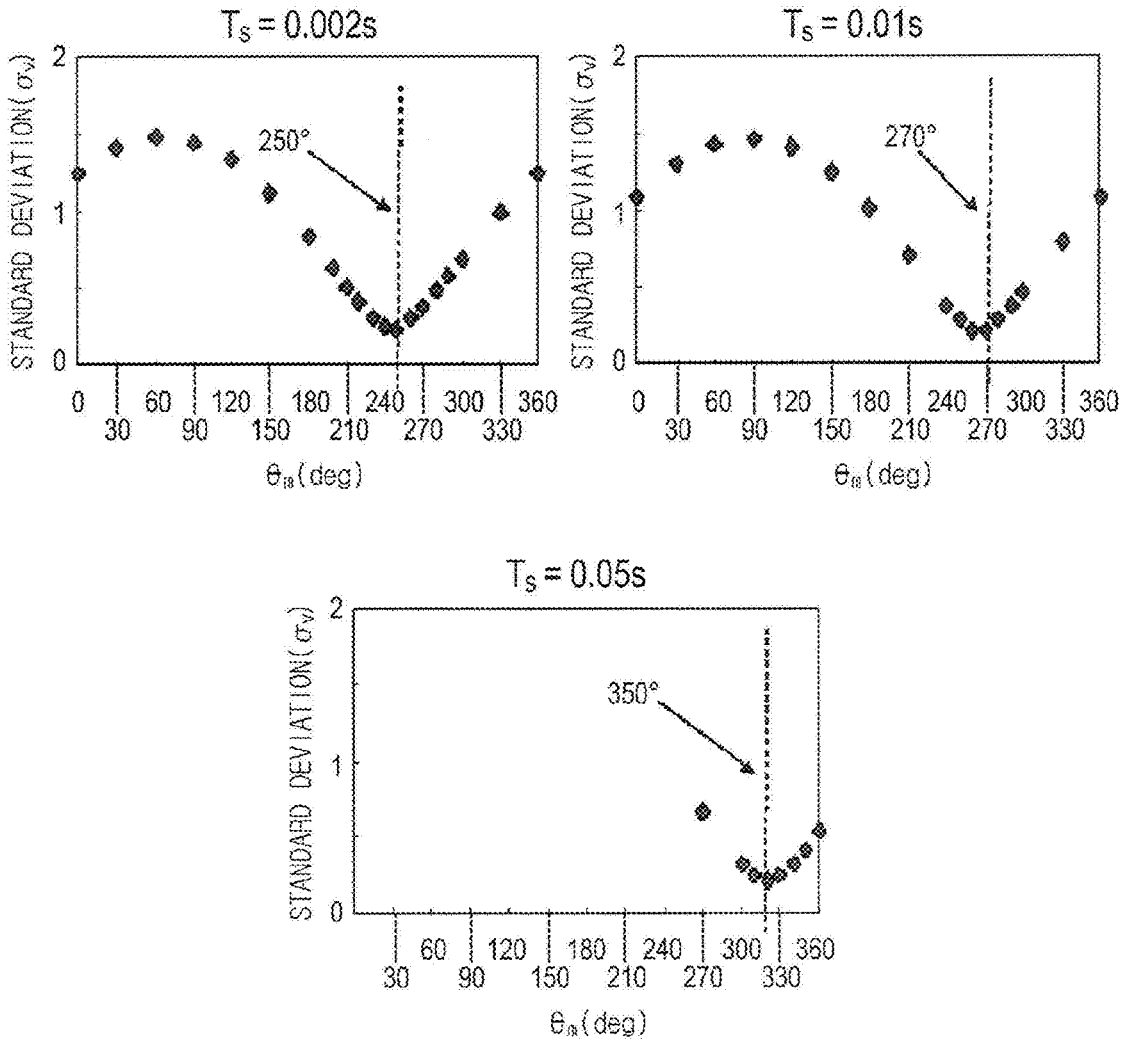
FIGS. 15 and 16 illustrate the standard deviation $\sigma_v$ of a rotating velocity of two image bearing bodies with respect to a phase angle $\theta_m$ of a motor input signal, according to an embodiment.
Figure 16:
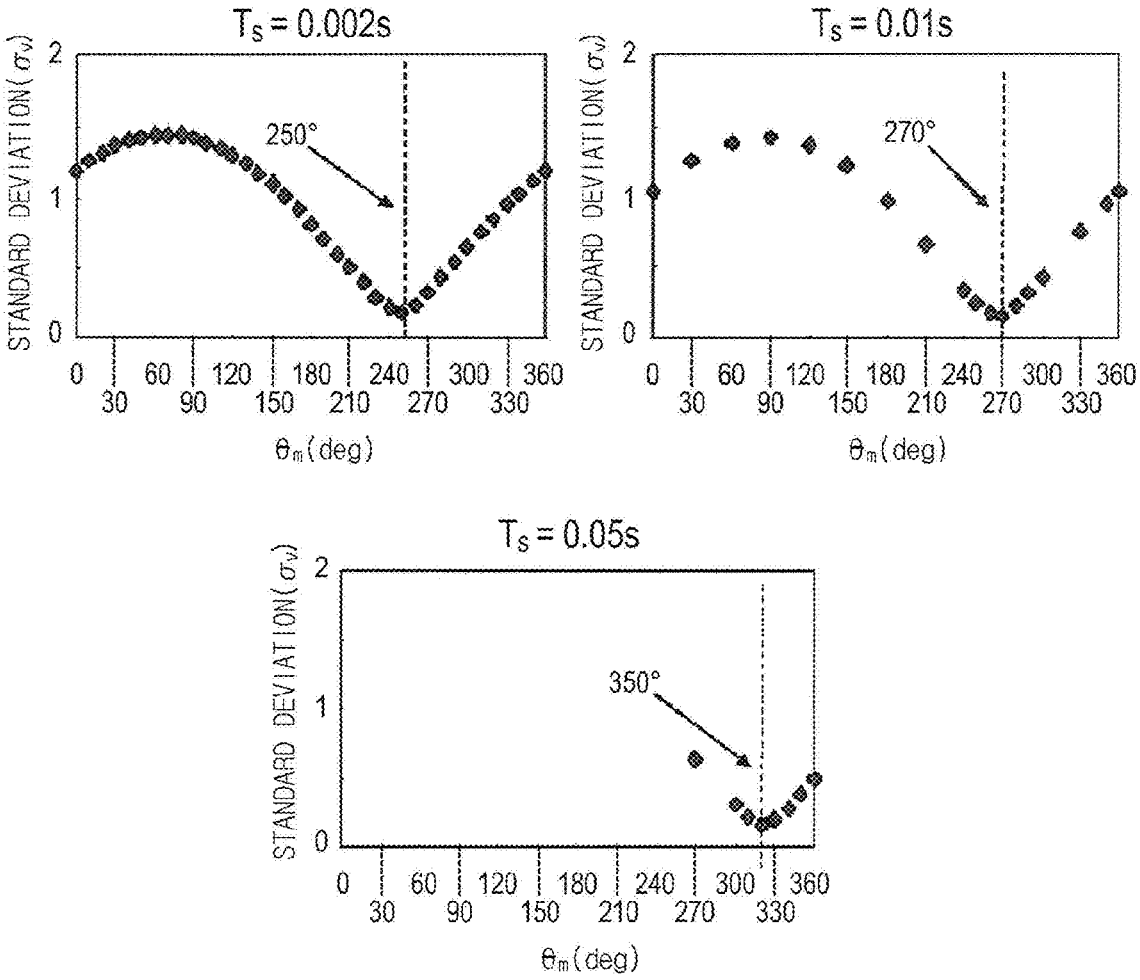

FIGS. 15 and 16 are graphs illustrating standard deviation $\sigma_v$ of the rotating velocity of the magenta image bearing body 110 and the cyan image bearing body 110 with respect to the phase angle $\theta_m$ of the motor input signal. FIGS. 15 and 16 indicate if the sampling time Ts is 0.002 second, 0.01 second and 0.05 second, the standard deviation $\sigma_v$ becomes minimal at the respective phase angle $\theta_m$ of 250°, 270° and 350° of the motor input signal.

The longer the sampling time Ts, the larger the phase angle $\theta_m$ of the motor input signal to minimize the standard deviation $\sigma_v$. Thus, if the sampling time Ts becomes longer, the phase angle $\theta_m$ of the motor input signal minimizing the amplitude of the AC velocity of the image bearing body 110 becomes larger. The shorter the sampling time Ts, the closer the discrete input signal is to an analog sine wave. Accordingly, time delay between the discrete input signal and output of the driving motor 120 may be reduced.

Figure 17:
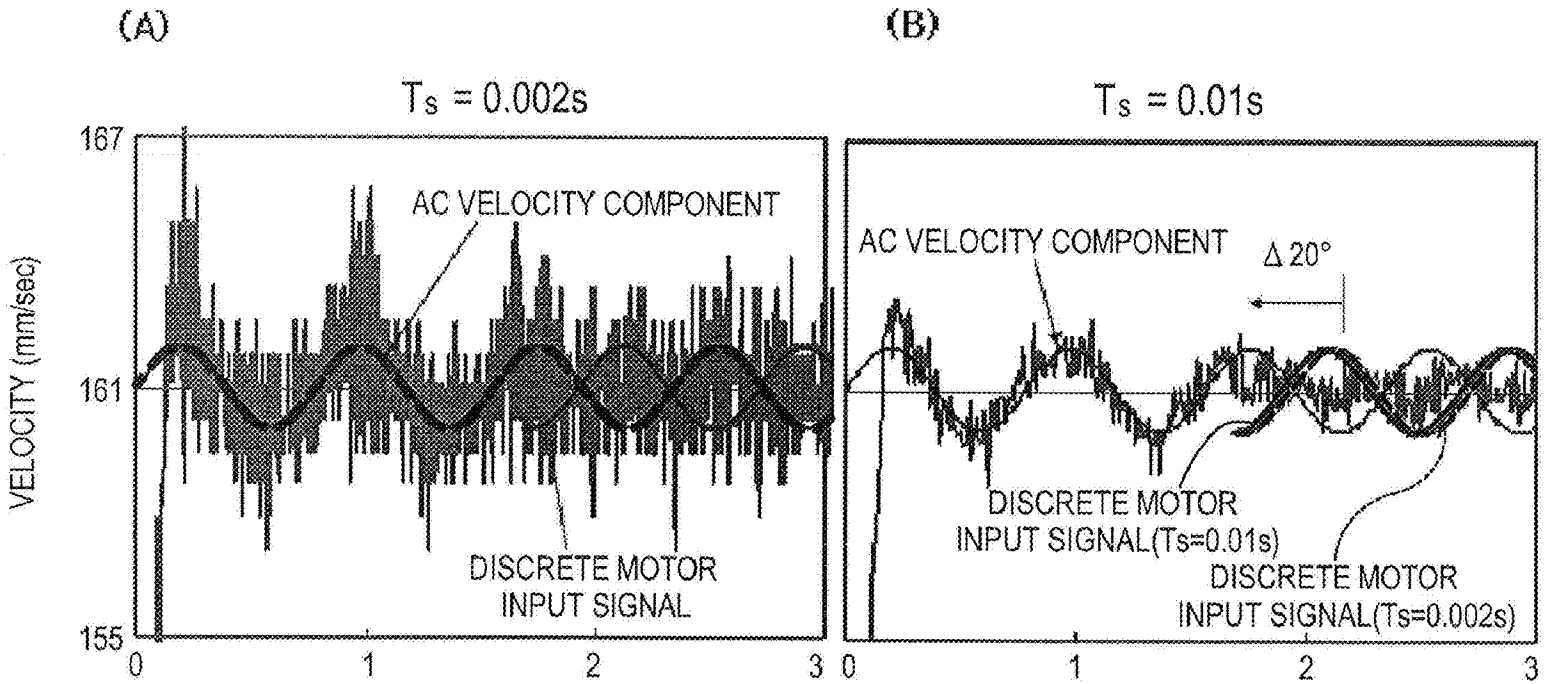
FIGS. 17A and 17B illustrate an AC velocity component and a motor input signal of an image bearing body for two sampling times, according to an embodiment.

FIGS. 17A and 17B illustrate the AC velocity component of the image bearing body 110 and the motor input signal if the sampling time Ts is 0.002 second and 0.01 second, respectively.

As shown in FIG. 17A, if the sampling time is 0.002 second, a phase difference of 180° exists between the AC velocity component of the image bearing body 110 and a discrete motor input signal sampling the continuous motor input signal in the formula (4) with the sampling time of 0.002 second. As shown in FIG. 17B, when the sampling time Ts is 0.01 second, the discrete motor input signal has a phase delay (time delay) of 20°.

Figure 18:
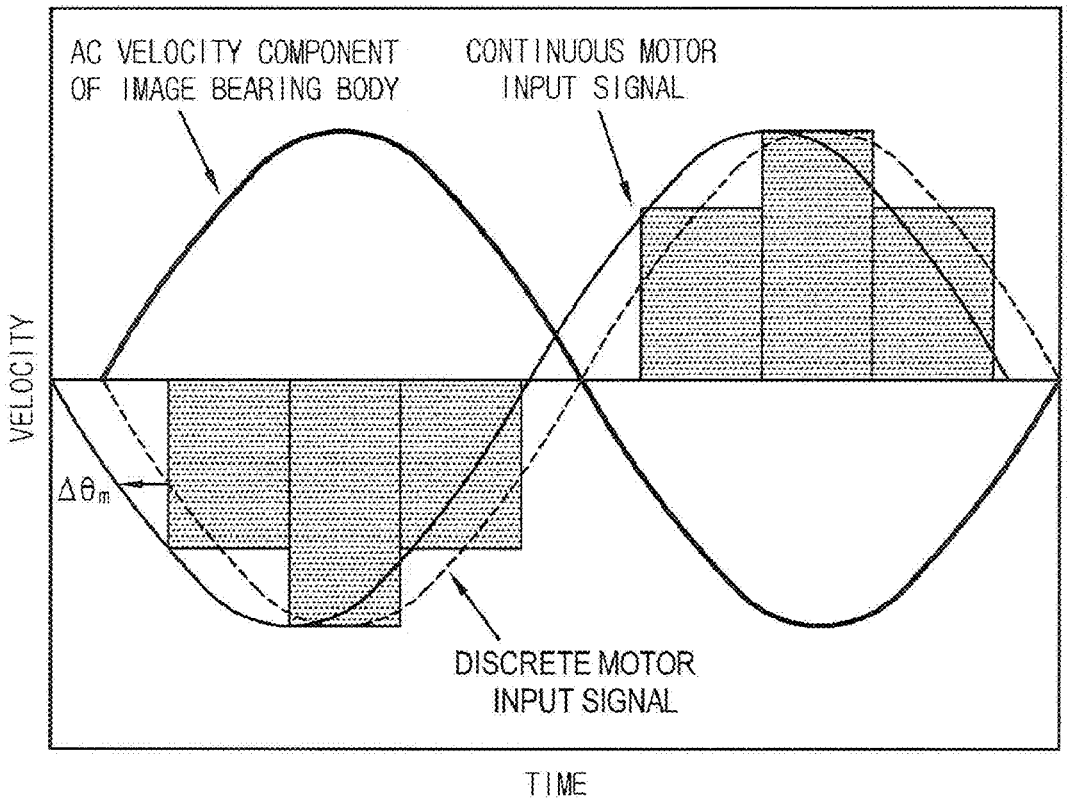
FIG. 18 illustrates a phase delay between an AC velocity component of an image bearing body, a continuous motor input signal and a discrete motor input signal, according to an embodiment.

As shown in FIG. 18, even if the continuous motor input signal is generated to offset the AC velocity component of the image bearing body 110, the phase delay (time delay, $\Delta\theta m$) according to the sampling time may occur in the actual discrete motor input signal that is input to the driving motor 120.

More specifically, if the sampling time is longer than 0.002 seconds, the phase angle $\theta_m$ of the motor input signal measured for the purpose of the testing shifts as much as the phase delay $\Delta\theta m$ to reduce the standard deviation of the AC velocity component. As shown in FIG. 18, the continuous motor input signal leads in phase as much as the phase delay $\Delta\theta m$ with respect to the AC velocity component of the image bearing body 110.

If the sampling time Ts is short, the phase delay $\Delta\theta m$ may also be reduced. However, load to the system is greater and thus the sampling time Ts may not be unconditionally small. If the sampling time is longer, the phase delay $\Delta\theta m$ is longer, as described above, and the actual discrete motor input signal has a phase different from that of the anticipated continuous input signal. Thus, the AC velocity component of the image bearing body 110 may not be removed effectively.

Figure 19A:
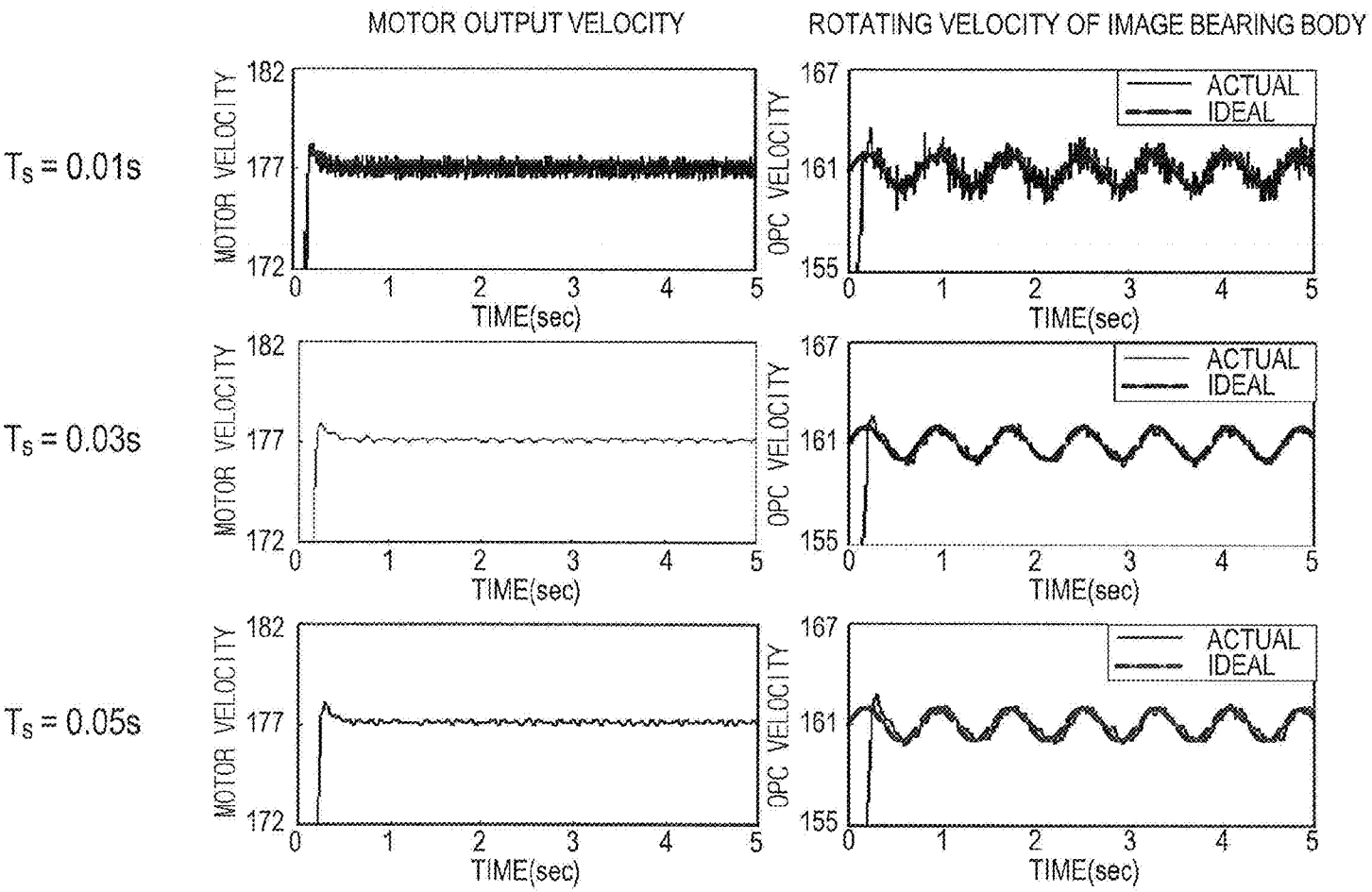
FIGS. 19A and 19B are graphs illustrating a motor output velocity according to time and a rotating velocity of an image bearing body depending on the motor output velocity for various sampling times, according to an embodiment.
Figure 19B:
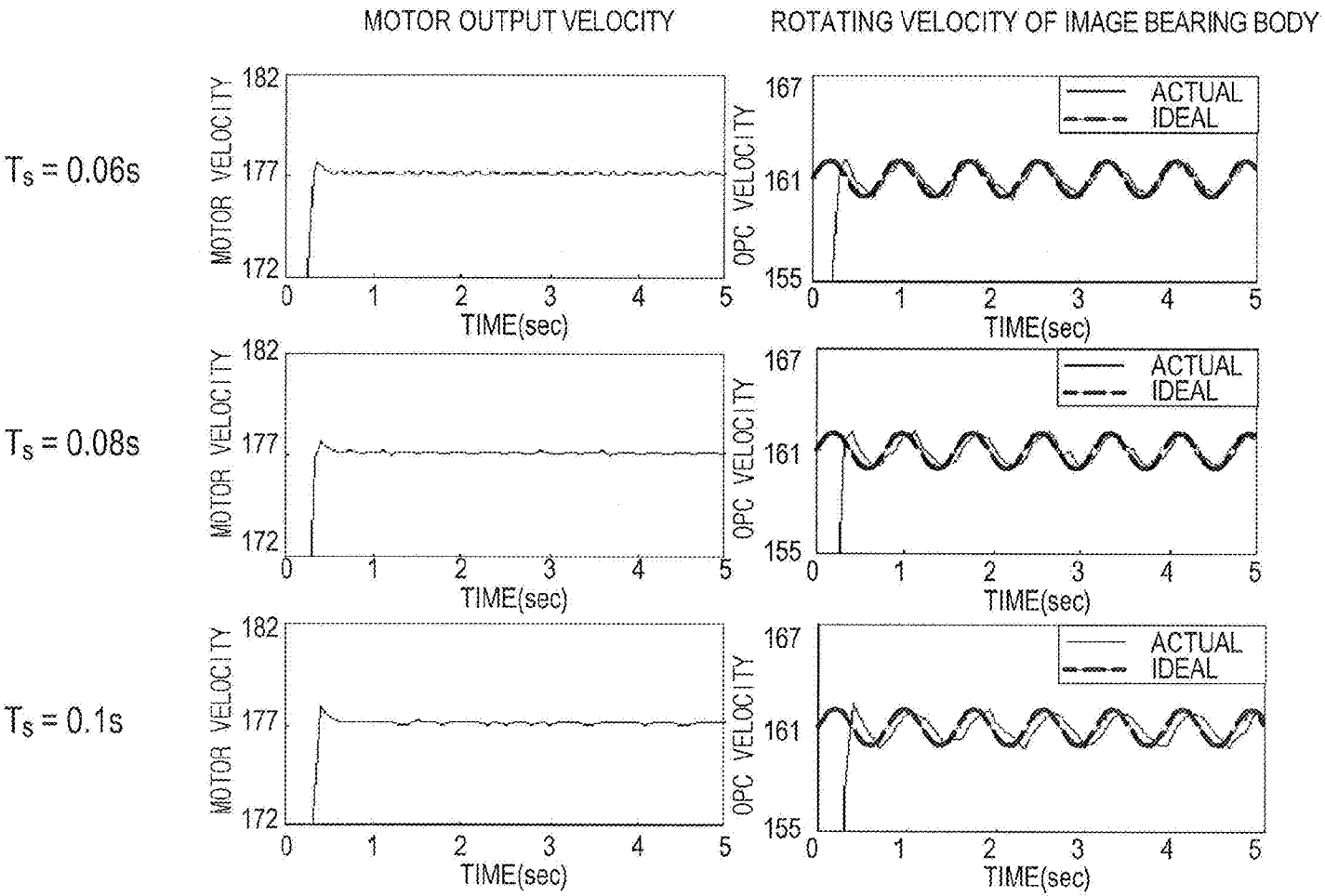

FIGS. 19A and 19B are graphs illustrating a motor output velocity as a function of time and a rotating velocity of the image bearing body 110 according to the motor output velocity for various sampling time Ts. A dash line graph in the "rotating velocity of image bearing body" graph refers to an ideal rotating velocity of an image bearing body, and a solid line graph refers to an actual rotating velocity of the image bearing body.

As illustrated in FIGS. 19A and 19B, if the sampling time Ts is 0.05 second or less, the AC velocity component in the dash line and solid line graphs are equal or nearly equal, and the actual rotating velocity follows or closely follows the ideal rotating velocity of the image bearing body. However, if the sampling time Ts exceeds 0.05 seconds, the actual rotating velocity does not follow the ideal rotating velocity of the image bearing body, and a difference exists between the actual rotating velocity and the ideal rotating velocity. According to an embodiment, the sampling time Ts may thus be selected with a value of 0.05 seconds or less.

Figure 20:
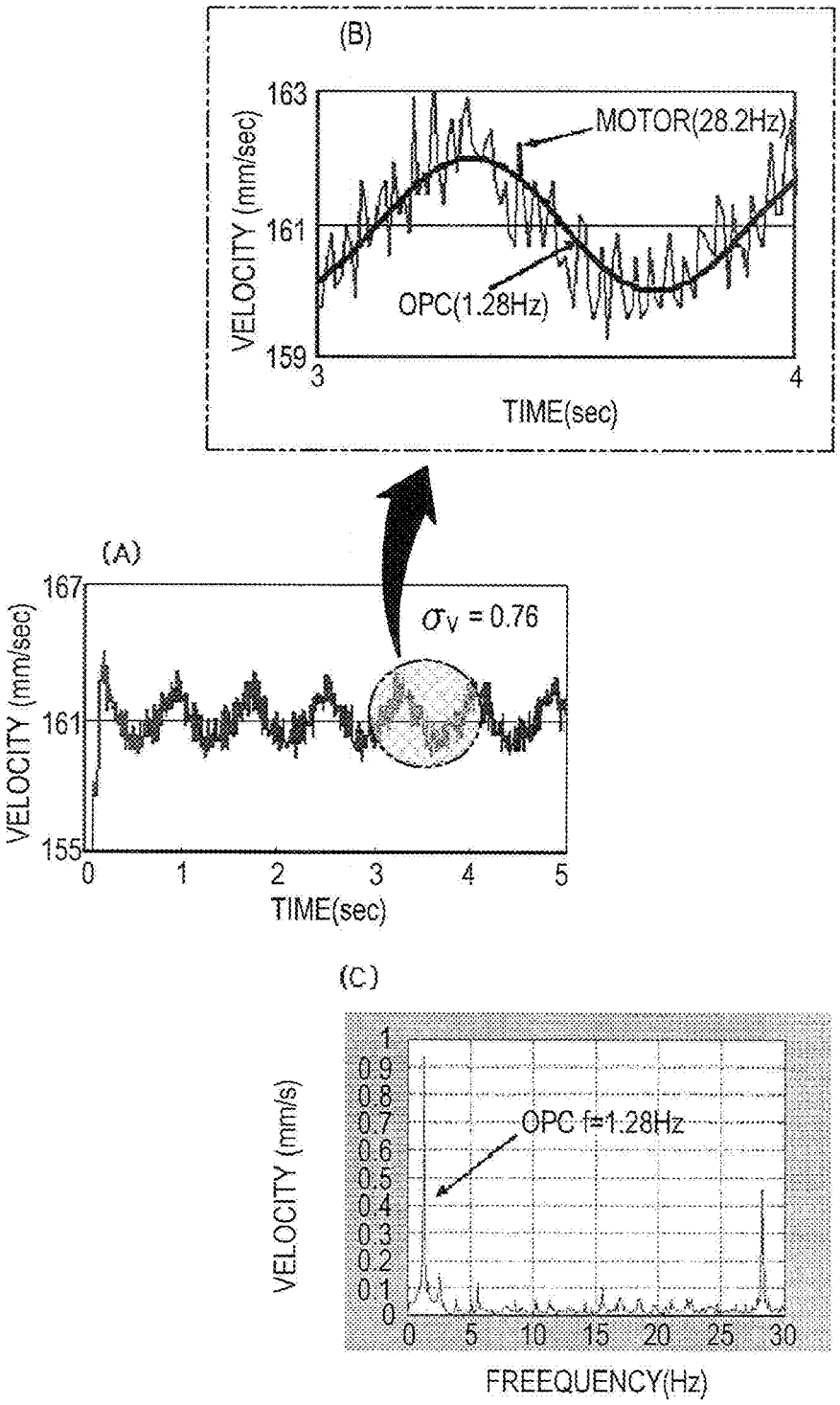
FIG. 20A is a graph illustrating a rotating velocity of an image bearing body if the velocity is controlled in a general control mode, according to an embodiment.
FIG. 20B is a graph which locally enlarges the graph of the rotating velocity in FIG. 20A.
FIG. 20C illustrates a frequency analysis of a rotating velocity, according to an embodiment.

FIG. 20A is a graph illustrating a rotating velocity of the magenta image bearing body 110 when a consistent motor input signal of 1268.4 PPS is provided to the driving motor 120 in the general control mode, according to an embodiment. FIG. 20B is an enlargement of a portion of the graph of the rotating velocity shown in FIG. 20A. FIG. 20C is a graph illustrating a frequency analysis of the rotating velocity in FIG. 20A.

FIG. 21A is a graph of a rotating velocity of the magenta image bearing body 110 if a motor input signal including the fluctuation component, as in the formula (4), is provided to the driving motor 120 in the constant velocity control mode, according to an embodiment. FIG. 21B is an enlargement of a portion of the graph of the rotating velocity shown in FIG. 21A. FIG. 21C is a graph illustrating a frequency analysis of the rotating velocity in FIG. 21A.

As shown in FIGS. 20A to 21C, the standard deviation $\sigma_v$ of the AC velocity component of the image bearing body 110 in the constant velocity control mode is 0.19 mm/sec, which represents a 75% reduction from the 0.76 mm/sec in the general control mode. According to the result of the frequency analysis, the dominant low frequency is 2.56 Hz in the constant velocity control mode, i.e., double the 1.28 Hz in the general control mode.

As shown in FIGS. 20B and 21B, a motor frequency of 28.2 Hz, which may be considered a relatively high frequency, includes an OPC frequency of 1.28 Hz or 2.56 Hz, which may be considered a low frequency. The OPC frequency is a multiplicative inverse of a one-time rotation period of the image bearing body 110, and refers to a rotating frequency of the image bearing body 110. The OPC frequency, more particularly the low frequency component thereof, thus may have a dominant impact on color registration.

Figure 22:
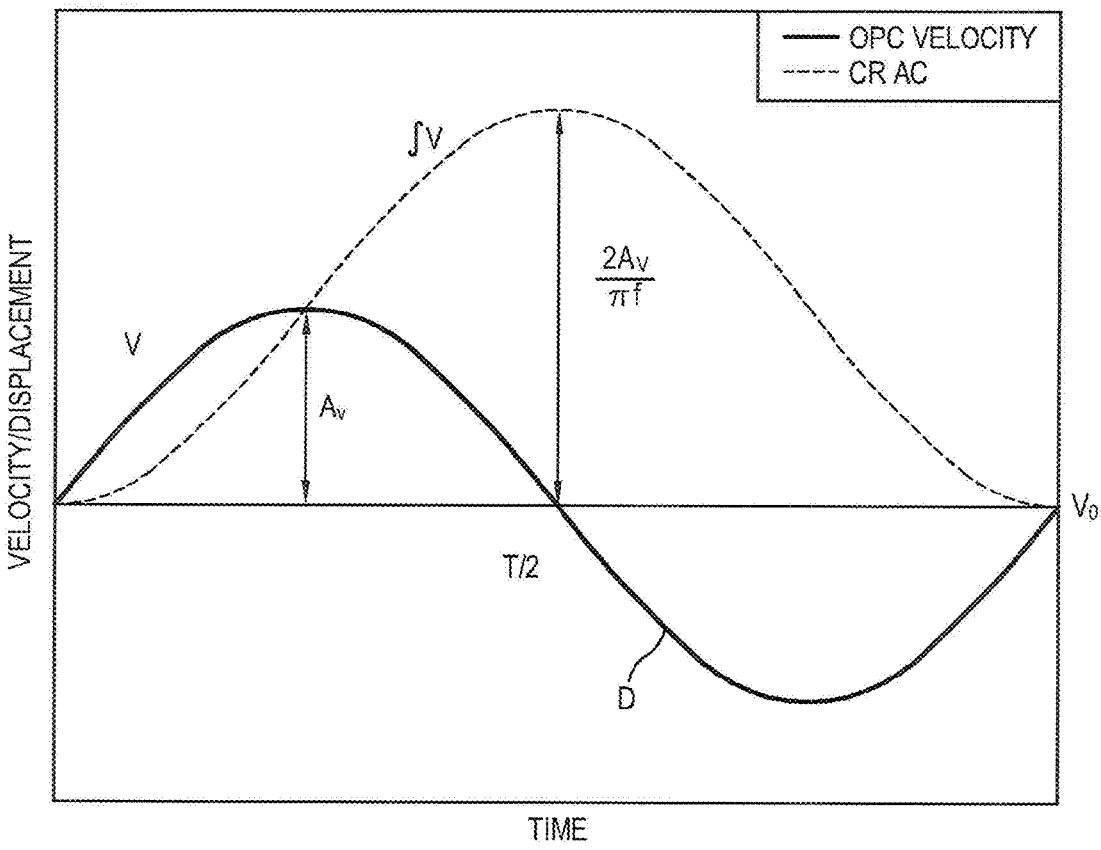
FIG. 22 illustrates a correlation between an AC velocity component of an image bearing body and color registration errors, according to an embodiment.

As illustrated in FIG. 22, the graph "CR AC" is a graph of an error of color registration as an integral of the approximated AC velocity component D of the image bearing body 110 over time. The error of color registration AC may be calculated by a following formula (5).

$$AC = \int_{t_0}^{t_0+\frac{T}{2}} V\,dt = \frac{V_0}{2f} + \frac{A_V}{\pi f}\cos(2\pi f t_0 + \theta_0) \qquad \text{Formula (5)}$$

Accordingly, Max (AC) of the error of color registration AC is as follows:

$$\mathrm{Max}(AC) = \frac{2A_V}{\pi f}$$

It can be observed that the maximum value of the error of color registration Max(AC) is inversely proportional to the frequency of the AC velocity component, and is directly proportional to the amplitude of the AC velocity component.

As previously described above, in the constant velocity control mode, the amplitude of the AC velocity component of the image bearing body 110 is reduced by 75% while the error of color registration is also reduced. More particularly, as the dominant low frequency doubles, the error of color registration being inversely proportional thereto may be reduced to about half. Thus, in the above example, Av=0.19 mm/sec, f=2.56 Hz, and Max(AC) is about 0.047 mm in the constant velocity control mode. The calculated continuous motor input signal may be stored in a memory, for example, the memory component 140 shown in FIG. 1.

Figure 23:
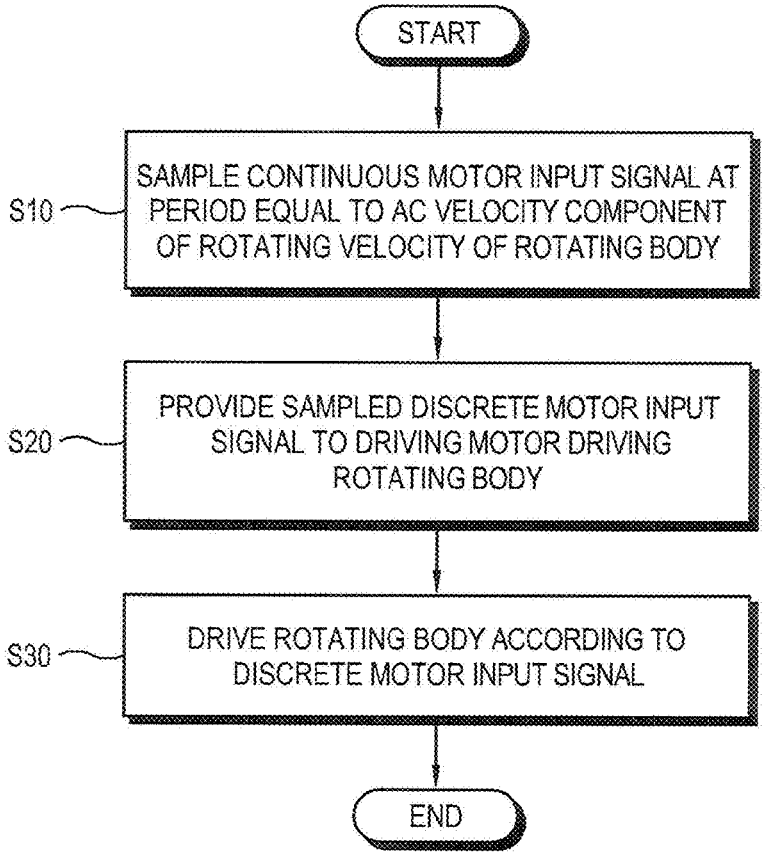
FIG. 23 is a flowchart of a velocity control method of a rotating body of an image forming apparatus, according to an embodiment.

With reference to FIG. 23, a velocity control method of a rotating body of an image forming apparatus, such as the apparatus 100, according to an embodiment is described.

At S10, a continuous motor input signal is sampled at a sampling period that is the same as the period of the AC velocity component of the rotating velocity of the rotating body.

The continuous motor input signal may be stored in the memory 140 of the image forming apparatus 100, for example. Accordingly, the continuous motor input signal stored in the memory 140 may be read and sampled. In an embodiment, the continuous motor input signal may be determined by empirically measuring an AC velocity component of the rotating body and generating a continuous motor input signal corresponding to the measured AC velocity component. If the continuous motor input signal is not stored in the memory 140, the controller 130 may generate the continuous motor input signal corresponding to the measured AC velocity component.

As would be readily understood by those skilled in the art, the controller 130 may be, e.g., a microprocessor, a microcontroller or the like, that includes a CPU to execute one or more computer instructions to implement the various control operations herein described and/or control operations relating to one or more other components of the image forming apparatus, and, to that end, may further include a memory device, e.g., a Random Access Memory (RAM), Read-Only-Memory (ROM), a flesh memory, or the like, in addition to or in lieu of the memory component 140 shown in FIG. 1, to store the one or more computer instructions.

The continuous motor input signal may be calculated by the formula (2) as the phase angle $\theta_m$ in the formula (2) is determined to reduce the AC velocity component. The phase angle $\theta_m$ may be 270°, for example, according to an embodiment.

At S20, the sampled discrete motor input signal is provided to the driving motor 120 that is configured to drive the rotating body.

At S30, the driving motor 120 drives the rotating body according to the discrete motor input signal.

As described above, the rotating body may include the image bearing body 110, which has a toner visible image on a surface thereof. In some cases, the rotating body may include another rotating body for which a constant velocity is required other than the image bearing body 110. For example, the rotating body may include one of a transfer roller or a driving roller driving the belt.

According to aspects of the above-described embodiments, the velocity fluctuation of the rotating body, such as an image bearing body, can be reduced, allowing the rotating body may rotate at a consistent velocity. Furthermore, an AC velocity component of the rotating velocity of the image bearing body may be minimized. A constant velocity of the image bearing body for example improves the proper application of developers in different colors to the desired locations on a print medium or a transfer belt. Accordingly, color registration may improve, realizing a clearer image.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. An image forming apparatus, comprising:

an image bearing body having a surface for carrying thereon a toner image;

a driving motor configured to drive the image bearing body according to a control signal; and a controller configured to output the control signal to the driving motor so as to cause the driving motor to output a motor output velocity having a period equal to that of an AC velocity component of the image bearing body to reduce the AC velocity component of the image bearing body fluctuating periodically, wherein the control signal comprises a discrete motor input signal to the driving motor, the discrete motor input signal being generated by sampling a continuous motor input signal at a sampling period, the continuous motor input signal corresponds to a sinusoidal wave approximation of a rotating velocity of the image bearing body having the AC velocity component, and the sinusoidal wave approximation has a phase angle that has been adjusted to minimize an amplitude of the AC velocity component, wherein the phase angle is about 270°, and wherein the controller is further configured to increase the phase angle as the sampling period becomes longer.

2. A method of controlling a rotating body of an image forming apparatus, comprising:

sampling a continuous motor input signal at a sampling period equal to a period of an AC velocity component of a rotational velocity of the rotating body to thereby obtain a sampled discrete motor input signal;

transmitting the sampled discrete motor input signal to a driving motor configured to drive the rotating body;

driving the rotating body by the driving motor according to the discrete motor input signal, wherein the continuous motor input signal corresponds to a sinusoidal wave approximation of the rotating velocity of the rotating body that includes the AC velocity component, and the continuous motor input signal comprises a sinusoidal wave with a phase angle that is adjusted so as to minimize an amplitude of the AC velocity component; and adjusting the phase angle according to a change in the sampling period.

3. A method of controlling a rotating body of an image forming apparatus, comprising:

inputting an input control signal to a motor device; and driving the rotating body to rotate at a rotational velocity with the motor device operating according to the input control signal, wherein the input control signal satisfies a relationship, $$Hz=B+Am\cdot\sin(w_m t+\theta_m),$$

wherein Hz is the input control signal in pulse per second (PPS), B corresponding to an average number of pulses per second input to achieve a desired rotational velocity of the rotating body, Am proportionally corresponding to an amplitude of fluctuation from the desired rotational velocity of the rotating body, $w_m$ corresponding to an angular velocity of the fluctuation expressed as 2nf, f representing an inverse of a period of the fluctuation, $\theta_m$ representing a phase angle of the input control signal.

4. The method according to claim 3, further comprising:

determining the phase angle $\theta_m$ of the input control signal by selecting an angle that minimizes the amplitude of fluctuation.

5. The method according to claim 3, wherein the phase angle $\theta_m$ ranges between 210° and 320°.

* * * * *

UNITED STATES PATENT AND TRADEMARK OFFICE

CERTIFICATE OF CORRECTION

PATENT NO. : 8,229,327 B2
APPLICATION NO. : 12/575106
DATED : July 24, 2012
INVENTOR(S) : Hyun-Ki Cho It is certified that error appears in the above-identified patent and that said Letters Patent is hereby corrected as shown below:

Column 14, Line 14, In Claim 3, delete "2nf," and insert -- 2πf, --, therefor.

Signed and Sealed this
Twentieth Day of November, 2012

David J. Kappos

David J. Kappos
*Director of the United States Patent and Trademark Office*